US006557223B2

(12) United States Patent
Greenway et al.

(10) Patent No.: US 6,557,223 B2
(45) **Date of Patent: *May 6, 2003**

(54) FABRIC HYDROENHANCEMENT METHOD & EQUIPMENT FOR IMPROVED EFFICIENCY

(75) Inventors: J. Michael Greenway, Westwood, MA (US); Jackson Lawrence, Nashville, NC (US); Herschel Sternlieb, Brunswick, ME (US); Frederick Ty, Walpole, MA (US); Frank E. Malaney, Charlotte, NC (US)

(73) Assignee: Polymer Group, Inc., North Charleston, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/075,951

(22) Filed: Feb. 15, 2002

(65) Prior Publication Data

US 2002/0121009 A1 Sep. 5, 2002

Related U.S. Application Data

(62) Division of application No. 08/986,132, filed on Dec. 3, 1997, now Pat. No. 6,442,809.

(51) Int. Cl.[7] ..... D04H 1/46
(52) U.S. Cl. ..... 28/104; 28/167
(58) Field of Search ..... 28/104, 105, 167, 28/163, 106, 103, 107; 8/147, 148, 149.1, 151, 151.1; 68/180, 176, 201, 203, 205 R; 442/408, 384

(56) References Cited

U.S. PATENT DOCUMENTS

| | | | | | |
|---|---|---|---|---|---|
| 2,317,375 A | | 4/1943 | Graham | 28/74 |
| 3,033,721 A | * | 5/1962 | Kalwaites | 28/105 |
| 3,214,819 A | | 11/1965 | Guerin | 28/72.2 |
| 3,274,018 A | * | 9/1966 | Russell et al. | 28/105 |
| 3,330,009 A | * | 7/1967 | Hynek | 28/105 |
| 3,493,462 A | | 2/1970 | Bunting, Jr. et al. | 161/169 |
| 3,613,999 A | | 10/1971 | Bentley et al. | 239/553.3 |
| 3,747,161 A | * | 7/1973 | Kalwaites | 28/105 |
| 3,800,364 A | * | 4/1974 | Kalwaites | 28/105 |
| 3,917,785 A | | 11/1975 | Kalwaites | 264/108 |
| 4,016,317 A | * | 4/1977 | Kalwaites | 28/105 |
| 4,190,695 A | | 2/1980 | Niederhauser | 428/234 |
| 4,233,349 A | | 11/1980 | Niederhauser | 428/92 |

(List continued on next page.)

FOREIGN PATENT DOCUMENTS

| | | | |
|---|---|---|---|
| CN | 19949494107191 | 12/1995 | D06B/3/32 |
| WO | PCT/DK90/00091 | 11/1990 | D06B/3/32 |

OTHER PUBLICATIONS

E. R. Trotman, Dyeing and Chemical Technology of Textile Fibres; Edward Arnold, A division of Hodder & Stoughton, London, Melbourne, Auckland; Sixth Ed., 1985, pp. 308, 310–12.

(List continued on next page.)

*Primary Examiner*—Amy B. Vanatta
(74) *Attorney, Agent, or Firm*—Wood, Phillips, Katz, Clark & Mortimer

(57) ABSTRACT

Improvements in Hydroenhancement efficiency are obtained by operating a manifold in relative movement to fabric transported under the manifold so as to deliver a low energy to the fabric per pass in multiple passes on the fabric. This results in greater enhancement efficiency and reduction in wasted energy, and also improves fabric coverage and reduces fabric shrinkage. The low-energy per pass, multiple-pass approach can be implemented with improved hydroenhancing equipment of reduced equipment size and cost which simulate multiple passes on the fabric. Embodiments employ a manifold or manifold system that is reciprocated, oscillated, or rotated to simulate multiple passes on the fabric. Other variations for improving hydroenhancement include angling the manifold at a diagonal to the fabric travel direction, using a high density number of double rows of jets to eliminate interference patterns.

15 Claims, 16 Drawing Sheets

U.S. PATENT DOCUMENTS

| | | | | | |
|---|---|---|---|---|---|
| 4,276,681 | A | * | 7/1981 | Marshall | 28/105 |
| 4,297,404 | A | * | 10/1981 | Nguyen | 28/105 |
| 4,442,161 | A | * | 4/1984 | Kirayoglu et al. | 28/104 |
| 4,556,601 | A | | 12/1985 | Kirayoglu | 428/219 |
| 4,647,490 | A | | 3/1987 | Bailey et al. | 428/131 |
| 4,691,417 | A | | 9/1987 | Vuillaume | 28/105 |
| 4,939,016 | A | | 7/1990 | Radwanski et al. | 428/152 |
| 4,967,456 | A | | 11/1990 | Sternlieb et al. | 28/104 |
| 4,995,151 | A | | 2/1991 | Siegel et al. | 26/69 |
| 5,023,130 | A | | 6/1991 | Simpson et al. | 428/227 |
| 5,042,722 | A | | 8/1991 | Randall, Jr. et al. | 239/553.5 |
| 5,136,761 | A | | 8/1992 | Sternlieb et al. | 28/104 |
| 5,142,752 | A | * | 9/1992 | Greenway et al. | 28/102 |
| 5,142,753 | A | | 9/1992 | Bolliand | 28/167 |
| 5,151,320 | A | | 9/1992 | Homonoff et al. | 428/284 |
| 5,173,360 | A | | 12/1992 | Hiroe et al. | 428/229 |
| 5,204,158 | A | | 4/1993 | Phillips et al. | 428/134 |
| 5,217,796 | A | | 6/1993 | Kasai et al. | 428/229 |
| 5,235,733 | A | | 8/1993 | Willbanks et al. | 28/105 |
| 5,238,644 | A | * | 8/1993 | Boulanger et al. | 28/104 |
| 5,274,893 | A | | 1/1994 | Kitamura et al. | 28/105 |
| 5,281,441 | A | | 1/1994 | Kasai et al. | 427/300 |
| 5,288,536 | A | | 2/1994 | Zafiroglu | 428/102 |
| 5,337,460 | A | | 8/1994 | Cockfield et al. | 28/167 |
| 5,405,684 | A | | 4/1995 | Cockfield et al. | 428/229 |
| 5,457,845 | A | | 10/1995 | Higgins et al. | 15/302 |
| 5,459,912 | A | | 10/1995 | Oathout | 28/105 |
| 5,475,905 | A | | 12/1995 | Cockfield et al. | 28/163 |
| 5,542,703 | A | | 8/1996 | Beasley | 280/739 |
| 5,657,520 | A | * | 8/1997 | Greenway et al. | 28/104 |
| 5,692,278 | A | | 12/1997 | Fleissner | 28/105 |
| 5,727,292 | A | * | 3/1998 | Vuillaume | 28/104 |
| 5,761,778 | A | * | 6/1998 | Fleissner | 28/104 |
| 5,791,028 | A | | 8/1998 | Zolin | 26/1 |

OTHER PUBLICATIONS

Phyllis G. Tortora, Understanding Textiles; MacMillan Publishing Company, New York; Fourth Ed., 1992, p. 413.

J. J. Pizzuto, A. Price, A. C. Cohen, Fabric Science; Fairchild Publications, New York; Fifth Ed. 1987, pp. 209–211.

* cited by examiner

FIG. 10
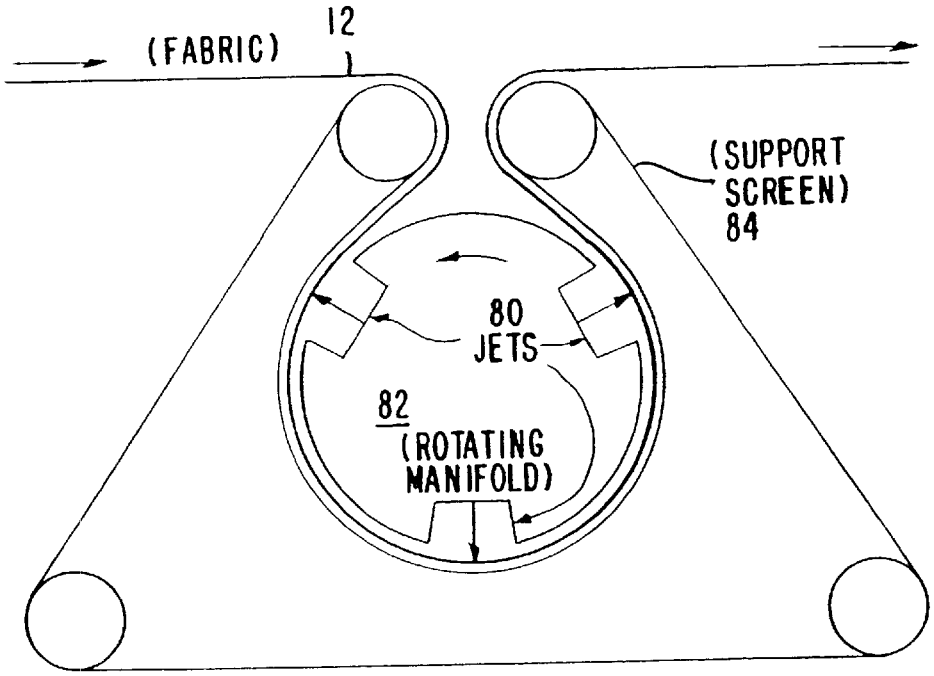
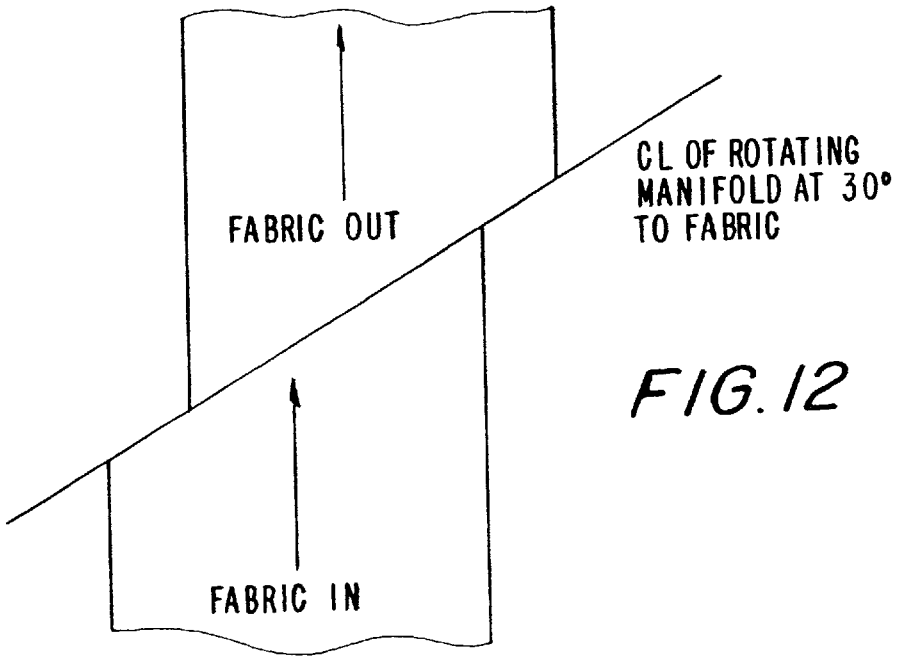
FIG. 12

FABRIC HYDROENHANCEMENT METHOD & EQUIPMENT FOR IMPROVED EFFICIENCY

This application is a divisional of application Ser. No. 08/986,132 filed on Dec. 3, 1997 now U.S. Pat. No. 6,442,809.

TECHNICAL FIELD

This invention generally relates to the field of hydroenhancing surface properties of textile fabric by subjecting it to hydrojet treatment, and more particularly, to improving the efficiency of fabric hydroenhancement methods and equipment.

BACKGROUND OF INVENTION

Prior hydroenhancement technology teaches that certain properties of woven or knitted fabrics, such as cover, yarn blooming, surface texture, hand, drape, etc., can be enhanced by impacting the surface of the fabric with rows of jet streams from a series of overhead manifolds as the fabric is conveyed on a support surface, as illustrated in FIG. 2, for example. Such conventional hydroenhancing equipment is described in greater detail in commonly-owned U.S. Pat. No. 4,967,456 of Sternlieb et al., issued on Nov. 6, 1990, entitled "Apparatus and Method For Hydroenhancing Fabric", which is incorporated herein by reference.

Generally, the conventional view has been that the degree of enhancement is related to the amount of energy imparted to the fabric. That is, the more energy delivered to the fabric, the more pronounced the enhancement effect. For example, U.S. Pat. No. 3,493,462 to Bunting teaches that the degree of surface treatment is related to the total energy E expended per weight of fabric in a pass under a hydrojet manifold, as calculated by the following equation:

$$E=0.125\ (YPG/sb),\ \text{in hp.-hr./lb. of fabric,}$$

where

Y=number of hydrojets (orifices) per linear inch of manifold,

P=pressure of fluid in the manifold, in p.s.i.g.,

G=volumetric flow of fluid in cu.ft./min. per orifice, s=speed of passage of fabric under the manifold, in ft./min., and b=weight of fabric treated, in oz./sq.yd.

This equation provided by Bunting is a standard calculation used in the industry for energy expended in the hydrotreatment of a fabric.

The degree of enhancement imparted to the fabric can be measured in terms of the cover of the fibers in the fabric. Cover has an inverse relation to the air permeability of the fabric, which is measured in cu.ft./min./sq.ft. (cfm/ft$^2$) The graph in FIG. 1 illustrates the relationship, as is known conventionally, between the total energy expended in hydrotreatment and the resulting air permeability property of the treated fabric. The graph shows that as the total energy expended (in hp-hr/lb) increases, the air permeability (in cfm/ft$^2$) of the fabric decreases and, hence, the degree of enhancement, i.e., the cover of the fabric, increases.

Conventional equipment for hydroenhancing fabric has employed high-speed processing lines having one or more manifolds in parallel across the width of fabric conveyed in a machine direction on a conveyor, as shown in FIG. 2, for example. A fabric web 12 is advanced through a weft straightener 14, which aligns the fabric weft prior to processing, onto conveyor belt 22 driven on rollers 24 in a machine direction (arrow indicating a downstream direction) through a hydroenhancing station 16. A plurality of manifolds 30 are spaced apart and aligned in parallel extending in a cross direction (normal to the plane of the figure) across the width of the conveyed fabric. Each manifold has a row of jet orifices 32 which emit jets of water downwardly to impact on one side of the fabric 12. The belt 22 has a porous support surface (such as a wire or plastic mesh) for supporting the fabric while allowing fluid to drain down to a collector system 19. The opposite side of the fabric may be treated in the same run by another hydroenhancing station 18 having a drum conveyor 34 and a series of manifolds 30 spaced around the drum circumferentially. Following hydroenhancement, the fabric 12 is advanced to a tenter frame 20 for drying under tension to produce a uniform fabric of specified width. A more detailed description of such hydroenhancing equipment is provided in commonly-owned U.S. Pat. No. 4,967,456 of Sternlieb et al., issued on Nov. 6, 1990, entitled "Apparatus and Method For Hydroenhancing Fabric", which is incorporated herein by reference.

Conventional techniques for obtaining suitable hydroenhancement of fabric include using high pressures of fluid jetted from the manifold, large-diameter jet orifices or lowered processing speeds to impact high energies of fluid per area of fabric per unit of time, and/or multiple manifold configurations. However, the requirements for handling high fluid pressures or fluid energies or multiple manifolds can increase the equipment size and complexity, as well as equipment and maintenance costs, significantly. The use of high total delivered energies, say in the range of 1.0 or 2.0 hp-hr/lb, is also less efficient, as improvements in fabric enhancement tend to taper off with further increases in energy. The use of high delivered energies can also cause greater fabric shrinkage, and can exacerbate the problem of interference patterns generated on the surface of the fabric by making traces of the jet streams more prominent in contrast to the yarn spacing in the fabric.

Hydroenhancement technology is related to technology for hydroentanglement or hydraulic needling of a web of fibers to produce autogenously bonded nonwoven fabric. In hydroentanglement technology, it has been the practice to obtain the desired degree of fiber entanglement with high energy input to the web of fibers. For the production of large quantities of hydroentangled fabric, large-scale, high-speed hydroentanglement lines and multiple-manifold equipment have been employed to deliver the needed hydroentanglement energies to continuously running webs. This type of large-scale equipment has also been used for hydroenhancement. However, it has a large capital cost which may only be justified for operations that can utilize very high output rates. For diversified product lines, the enhancement of different types of fabric in medium to small quantities requires equipment that is less capital intensive, adaptable to different fabrics, and more efficient to operate.

It is therefore a principal object of the present invention to improve the efficiency of fabric hydroenhancement by employing equipment that is smaller in size, can be adaptably configured for different types of fabrics, and delivers fluid energies for hydroenhancement in an optimized manner without wasting energy. It is a specific object of the invention to obtain comparable or even improved enhancement of fabrics with equipment that is greatly reduced in cost to build, operate, and maintain. A further object is to provide improved methods and equipment for fabric hydroenhancement that allow greater flexibility in making process adjustments for enhancing different types of fabrics and types of surface treatments. Still further objects of the invention include reducing warp yarn shrinkage and eliminating interference patterns in hydroenhancement of fabric.

SUMMARY OF INVENTION

In the present invention, the efficiency of fabric hydroenhancement can be improved by treating fabric with fluid jets at low levels of fluid energy per pass in multiple passes over the fabric. This can be carried out with compact equipment designed to simulate multiple passes on the fabric, which is of smaller scale and significantly reduced cost than conventional hydroenhancing equipment.

In a preferred embodiment of improved hydroenhancing equipment in accordance with the invention, referred to herein as "jigging equipment", a length of fabric is conveyed back and forth between a pair of unwind/windup reels on a sinuous path between a pair of manifolds for treating opposite sides of the fabric in multiple passes. The manifolds may be aligned at an angle to the vertical relative to support rolls supporting the fabric in order to allow convenient drainage of fluid away from the path of the fabric around the support rolls. This can eliminate the need for vacuum-suction removal of fluid. As an improvement to reduce equipment size, small-diameter solid support rolls may be used in treating certain type of fabrics.

The jigging equipment is configured to be self-contained and small in size. Only two manifolds are used to treat both sides of the fabric. This eliminates the need for the large and costly type of conventional processing lines that employ multiple manifolds and an extensive conveyor and fluid removal system for treating fabric in one continuous run. Suitable hydroenhancement of fabric can be obtained, for example, by conveying it back and forth 5 to 12 times (depending on fabric construction and the enhancement desired) between the reels with a manifold fluid pressure of 1800 psi. The total energy can be as low as 0.12 hp-hr/lb (0.062 hp-hr/lb per side). The low-energy, multiple-pass approach converts more of the delivered fluid energy to enhancement energy for greater efficiency and reduction in wasted energy, and also improves fabric coverage and reduces fabric shrinkage.

Other preferred embodiments of improved hydroenhancing equipment utilize a manifold or manifold system that is reciprocated, rotated, or oscillated relative to the fabric transport to simulate multiple passes on the fabric. In one version, a short section of manifold is reciprocated across or at an angle to the fabric travel direction to apply a jet curtain in overlapping swathes on the fabric in order to simulate multiple passes. The speed of reciprocating the manifold is selected relative to the fabric travel speed to obtain the desired number of passes per area of fabric per unit of time.

In another version of the improved hydroenhancement equipment, a pair of manifolds are coupled together and oscillated to simulate multiple passes on the fabric while conserving oscillation energy. The two manifolds can be arranged on the same side of the fabric to double the number of passes, or on opposite sides of the fabric for two-sided treatment in one run. The manifolds may be placed at an angle to the fabric travel direction (and warp yarns) for eliminating interference patterns in the fabric.

In another version, a plurality of jet strips are mounted on a rotating drum manifold to apply multiple jet curtains in overlapping swathes on the fabric in order to simulate multiple passes. The drum manifold may also be arranged at an angle to the fabric travel direction for eliminating interference patterns in the fabric. Each jet strip may be mounted in a jet module that is inserted in a cavity on the periphery of the drum and held in place by pressure-fitting sealing strips.

As another feature of the invention, a manifold for the improved hydroenhancing equipment, of the type having a plenum for receiving input fluid under pressure and communicating through a row of distribution holes to an output end mounting a jet strip with jet orifices formed therein, has a baffle interposed downstream of the row of distribution holes and in close proximity to the jet strip for inducing turbulence in the fluid flow to cause the jets emitted from the jet orifices to have a constantly fluctuating cross-sectional shape, direction, and structure. For example, the resulting jets may be emitted as randomly spiralling ribbons. This results in distributing the delivered energy of the jets over a constantly changing impact area on the fabric for more efficient utilization of enhancement energy, and also improved enhancement of fabric including reducing or eliminating interference patterns in the fabric.

Another, combined-manifold embodiment of improved hydroenhancing equipment employs paired manifolds, with a downstream manifold having jets pointing vertically downward on the fabric and an upstream manifold having jets biased at an angle toward the fabric travel direction. The combined-manifold configuration results in improved utilization of delivered energy and fabric cover. A dense spacing of jets, or a double row of jets, may be used to eliminate interference patterns. The manifolds may also be angled across the fabric travel direction to eliminate interference patterns.

The low-delivered-energy, multiple-pass technique can also be implemented with conventional hydroenhancing equipment by increasing the process (line) speed to reduce the energy per pass delivered to the fabric and processing the fabric with multiple manifolds and/or in multiple runs. Good results have been obtained by operating a conventional line with multiple manifolds operated at conventional fluid pressures and energy levels but at high line speeds so that the delivered energy per side is lowered. Good enhancement with low energy delivered by multiple manifolds.

Other objects, features, and advantages of the present invention are described in further detail below, with reference to the following drawings:

BRIEF DESCRIPTION OF DRAWINGS

FIG. 10 shows another embodiment of improved hydroenhancing equipment employing a rotating multi-strip drum manifold for simulating multiple passes on the fabric.

FIGS. 12, 13, and 14 illustrate the effect of arranging the drum manifold at an angle to the fabric travel direction to eliminate interference patterns.

DETAILED DESCRIPTION OF INVENTION

The present invention proceeds from the realization that equipment costs can be reduced and improvements in efficiency of fabric hydroenhancement can be obtained by treating fabric with fluid jets at low levels of fluid energy delivered to the fabric per pass in multiple passes over the fabric. This is in contrast to the conventional approach of using large-scale hydroenhancing lines which treat fabric with relatively high amounts of total energy delivered in one processing run.

It is theorized that in conventional hydroenhancing systems, when high fluid energies are used, there is an initial blooming of yarns when the fluid initially strikes the fabric, but most of the remaining energy is wasted. The application of low energy per pass in multiple passes in the present invention is counter-intuitive to the conventional approach of applying high fluid energy with multiple manifolds. Delivering low energy to the fabric per pass in multiple passes results in more "enhancement energy" being used for blooming yarn in the fabric and less energy being wasted. A desired level of enhancement can be obtained cumulatively by subjecting the fabric to limited treatment in multiple passes.

The low-energy-per-pass, multiple-pass approach of the invention can be implemented using improved equipment which is compact in size and of reduced cost. The improved equipment is characterized by delivering a low energy per pass and simulating multiple passes on the fabric. Certain preferred embodiments are described below. However, it should be understood that the low-energy-per-pass, multiple-pass approach may be adapted to other types of hydroenhancing equipment which utilize the same principles dislcosed herein.

I. Compact, Jigging Hydroenhancing Equipment

Figure 3:
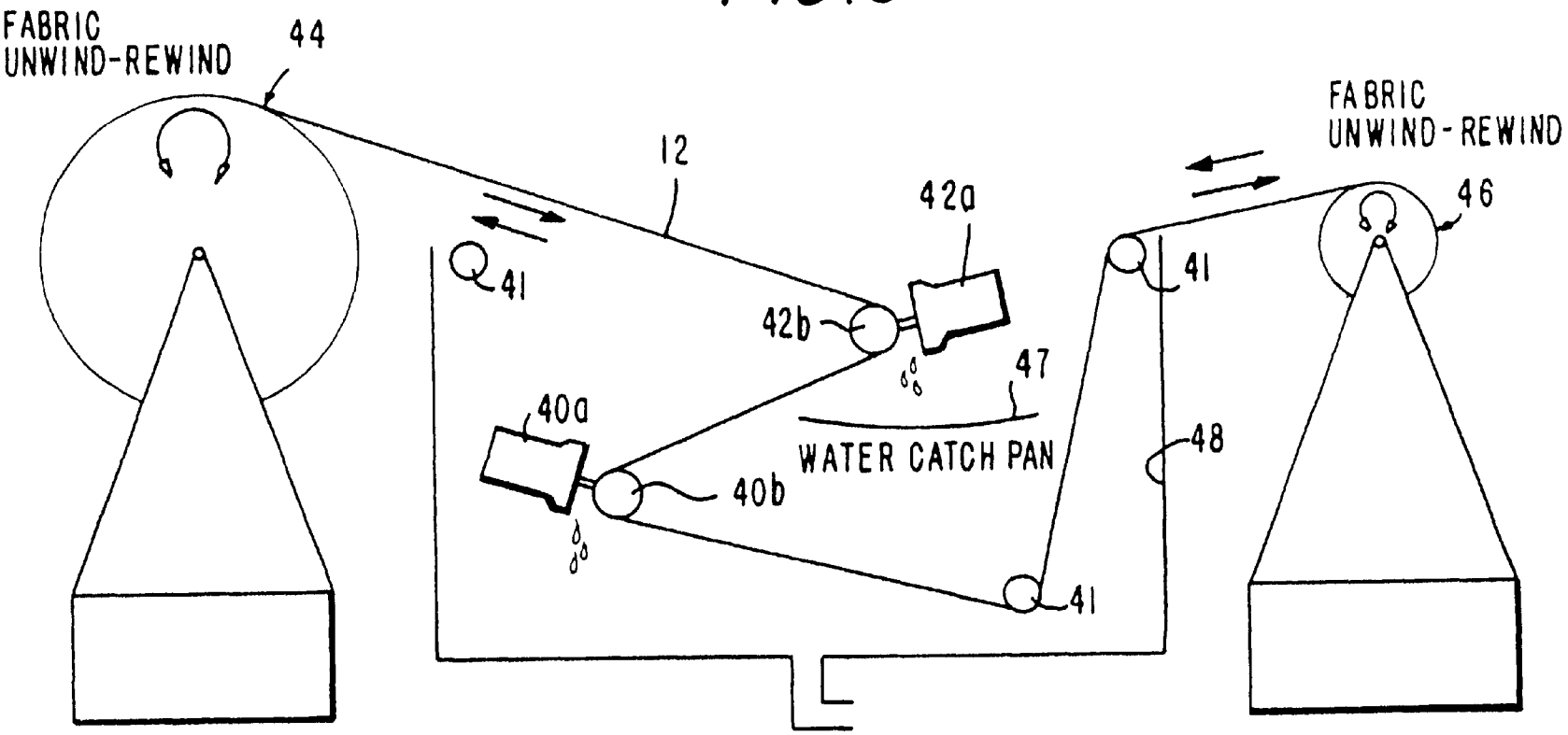
FIG. 3 shows one embodiment of improved hydroenhancing equipment employing a pair of stationary manifolds on opposite sides of the fabric and a pair of unwind/windup reels for simulating multiple passes on the fabric by jigging the fabric back and forth from one reel to the other.

Referring to FIG. 3, one embodiment of improved hydroenhancing equipment for carrying out the low-energy-per-pass, multiple-pass method of the present invention is shown having a pair of stationary manifolds 40*a*, 40*b* which impact a row of fluid jet streams onto respective opposite sides of the moving fabric 12 against respective support rolls 42*a*, 42*b*. The components are arranged compactly within an overall containment structure 48. The fabric 12, guided around guide rolls 41, is jigged back and forth a number of times under the manifolds to simulate multiple passes, by unwinding it from one of the reels 44, 46 and winding it up on the other reel, and vice versa.

As an improved feature, the support rolls 44, 46 may be small-diameter solid rolls which have been found to be suitable for hydroenhancing some types of fabric. For example, the rolls may have a diameter of about 4 inches and a smooth or textured surface. With the small-diameter rolls, the manifolds can be aligned at an angle to the vertical direction relative to the rolls, in order to allow convenient drainage of fluid downward away from the path of the fabric around the support roll. A simple water catch pan 47 can be used to collect water drained away from the jets of the manifold 42*a* impacting the fabric. The bottom of the overall containment structure 48 can be used to collect water drained away from the jets of the manifold 42*b*. The collected water is filtered and recirculated, or discharged to sewer. The simple water collection arrangement eliminates the need for the more typical vacuum-suction removal of fluid.

Suitable hydroenhancement of fabric can be obtained using this "jigging equipment" by operating the manifolds at relatively low energy levels and jigging the fabric back and forth a number of times to simulate multiple passes. Typical operating parameters for the jigger equipment are given below:

| Fabr. Wt. ($oz/yd^2$) | Speed (ypm) (ypm) | Pressure (psi) | Passes # | Energy (hp-hr/lb) |
|---|---|---|---|---|
| 4 | 100 | 1800 | 9 | 0.5 |
| 6 | 100 | 1800 | 14 | 0.5 |
| 8 | 100 | 1800 | 18 | 0.5 |
| 10 | 100 | 1800 | 23 | 0.5 |
| 5.7 | 326 | 1800 | 12 | 0.125 |

The jigging equipment is configured to be self-contained and small in size taking less floor space. Two manifolds can treat both sides of the fabric in one run. Multiple manifolds may also be used, if desired. An even number of passes results in the fabric being wound on the same roll it started from, whereas an odd number of passes results in its being wound on the other roll. Line speeds may vary between 40 and 350 ypm. It is estimated that a production efficiency per unit cost of jigging equipment of about five times that of conventional equipment can be achieved.

Figure 4:
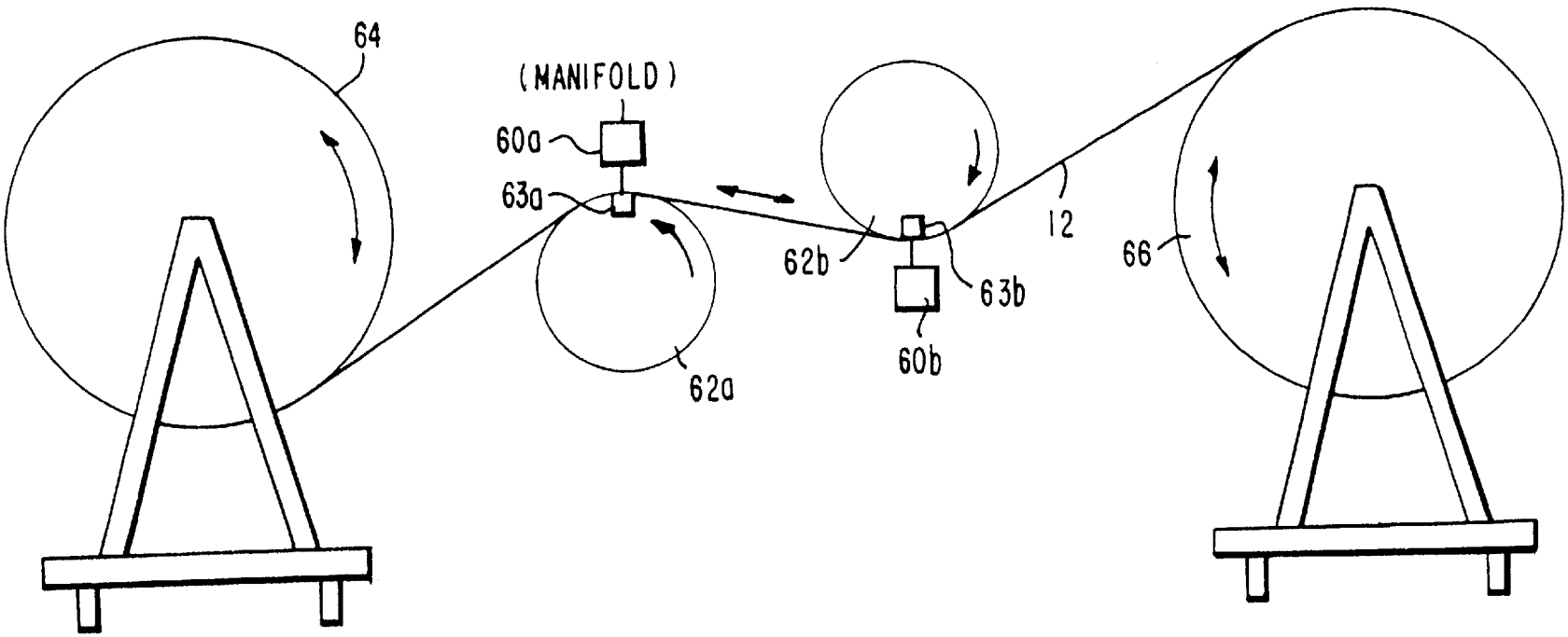
FIG. 4 is a schematic diagram of a preferred embodiment of the jigging hydroenhancement equipment having support drums provided with vacuum suction elements for water removal.

A preferred embodiment of jigging hydroenhancement equipment which can be used with all types of fabric is shown in FIG. 4 having stationary manifolds 60*a,* 60*b* which emit jet streams against respective support drums 62*a,* 62*b* on respective opposite sides of the fabric 12 conveyed back and forth between the pair of bi-directional unwind/windup reels 64, 66. The support drums 62*a,* 62*b* are of the more conventional type having a porous drum surface and vacuum-suction boxes on the inside of the drums for removal of fluid.

II. Compact, Reciprocating Manifold

Another embodiment of improved hydroenhancement equipment has a compact manifold or manifold system that is reciprocated, rotated, or oscillated relative to the transported fabric to simulate multiple passes on the fabric. This type of compact system is of smaller scale and can have a greatly reduced cost as compared to a conventional hydroenhancing line.

Figure 5:
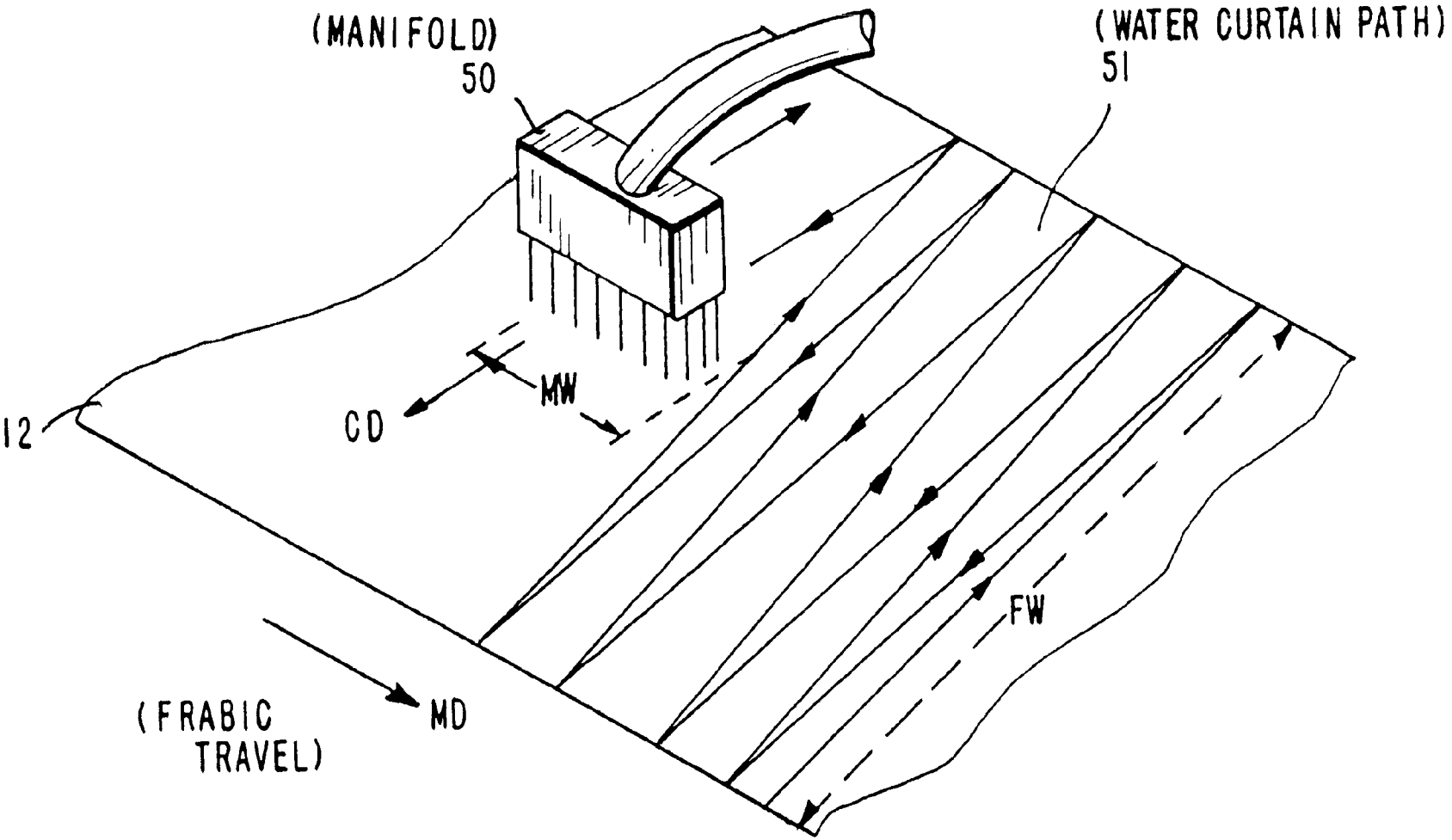
FIG. 5 is a schematic diagram of another embodiment of improved hydroenhancing equipment employing a compact, reciprocating manifold for simulating multiple passes on a fabric which enables the fabric to be enhanced in a cross direction in a continuous process.

Referring to FIG. 5, one version of the improved hydroenhancing equipment employs a short, compact section of manifold 50 that is reciprocated in the cross direction (CD) back and forth across the width FW of the fabric 12 being transported on a conveyor (not shown) in a downstream fabric travel direction (machine direction) MD. The resulting path of the short manifold section 50 is a zig-zag path 51 traversing back and forth at a relatively acute angle across the width of the fabric. The manifold has a row of jets that generates a water curtain of a width MW applied in overlapping swatches on the fabric. The ratio of traversing speed of the manifold 50 to the moving speed of the fabric and the manifold width MW are selected to enable the water curtain to deliver a low energy per pass in multiple passes on the fabric. For example, to simulate 16 passes over a fabric having a width FW of 6 feet and moving at a line speed of 10 fpm, a manifold having a curtain width MW of 2 feet can be reciprocated at a speed of 480 fpm to traverse the fabric 16 times in the time it takes the fabric to move 2 feet in the MD.

The traversing mechanism (not shown) for reciprocating the manifold 50 can be of any conventional type. The hydroenhancing station may employ an open mesh belt for the fabric transport, as well as other processing components used conventionally. Since the manifold has a shorter width MW (2 feet) for the partial row of jets, as compared to a conventional manifold extending across the full width (6 feet) of the fabric, the manifold structure is required to handle much less water volume and pumping and pressurization capacity than the conventional equipment.

Figure 6:
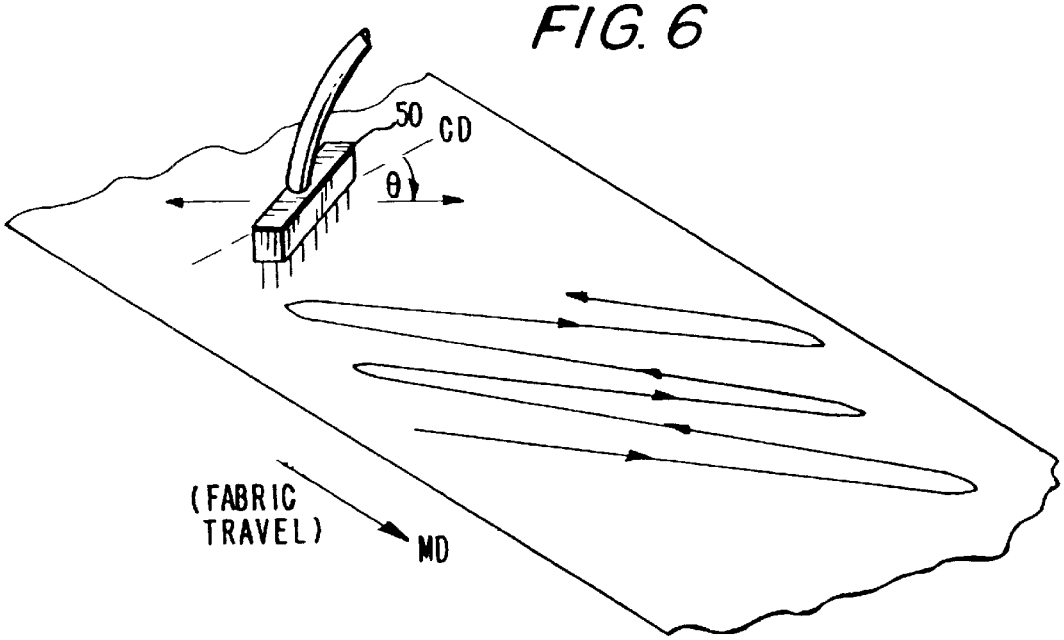
FIG. 6 shows a modification of the manifold of FIG. 5 arranged to reciprocate at an angle to the fabric travel direction which enables the fabric to be enhanced in a diagonal direction in a continuous process.

As illustrated in FIG. 6, the manifold 50 can be arranged, in a further modification, to reciprocate at a diagonal angle to the travel direction MD of the fabric. This would have the advantageous effect of eliminating interference patterns that might be generated between the spacing of the jets with the regular spacings of the yarn. It would also provide greater flexibility for adjusting the traversing/fabric speed ratio, and thus the levels of energy delivered per pass and the numbers of passes applied per given time.

Instead of orifices delivering jets in columnar streams, the manifold can employ a row of fan jets, for example, as described in commonly-owned U.S. Pat. No. 4,995,151 of Siegel et al., issued on Feb. 26, 1991, entitled "Apparatus and Method For Hydropatterning Fabric", incorporated herein by reference. The larger diameter of the fan jets and simpler structure can further reduce equipment costs. The use of fan jets can eliminate the generation of interference patterns since the overlapping fan jets create a continuous water curtain that will not trace lines on the fabric.

Figure 7:
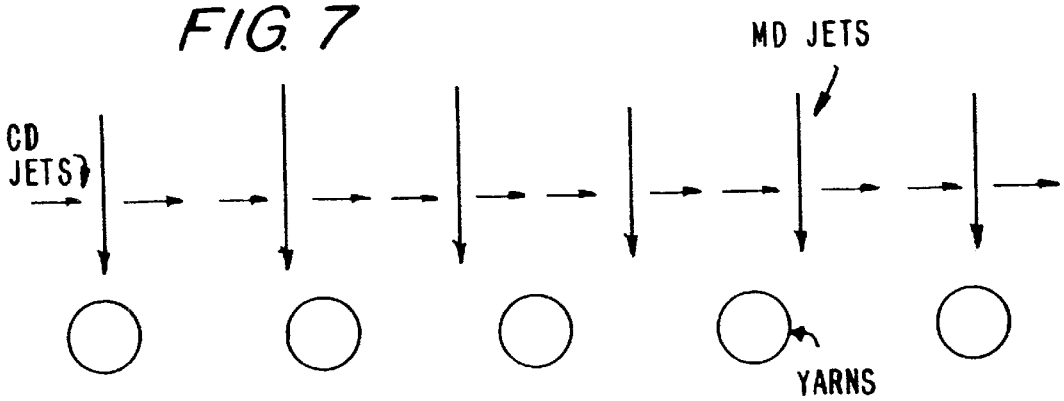
FIG. 7 illustrates schematically how operation of the reciprocating manifold in the cross or diagonal direction avoids the generation of interference patterns with warp yarns in the fabric.

Diagonal enhancing may be particularly advantageous in the case of continuous filament fabrics. In conventional equipment, a stationary manifold emitting jet streams of a fixed inter-jet spacing can result in tracing regularly spaced lines in the machine direction on the moving fabric. As illustrated in FIG. 7, the regular spacings of the MD-tracing jets and the MD-aligned warp yarns can produce a recurring moire pattern of machine direction stripes in the fabric, referred to as moire. With the compact reciprocating manifold of the invention, the fluid jets are applied back and forth at high speed in the cross direction CD or at a diagonal, so that moire patterns are eliminated.

III. Oscillating Manifold or Manifold System

Figure 8:
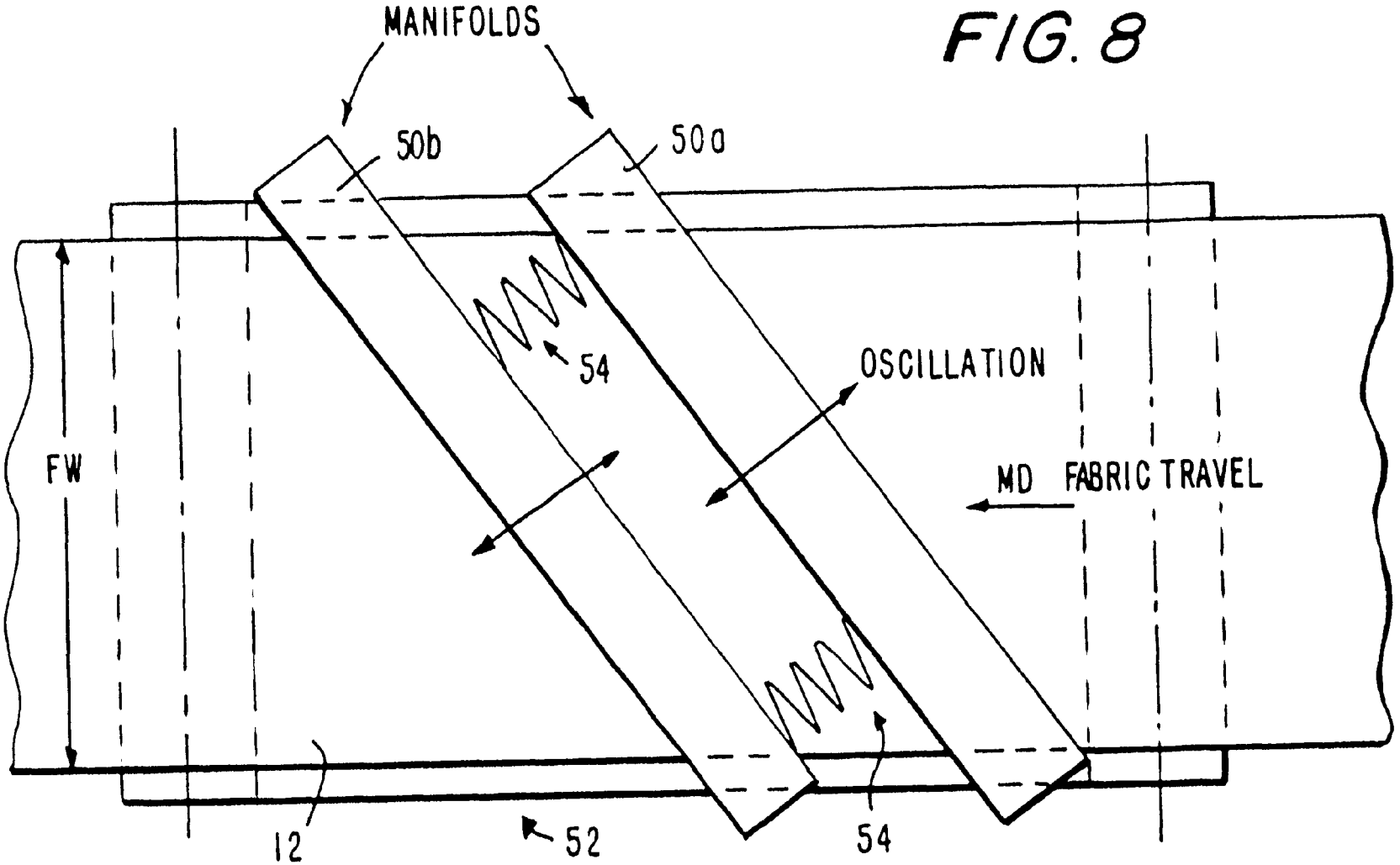
FIG. 8 is a schematic diagram of another embodiment of improved hydroenhancing equipment employing a pair of oscillating manifolds on the same side of the fabric for simulating multiple passes on the fabric and enables the fabric to be enhanced in a diagonal direction in a continuous process.

Referring to FIG. 8, another version of improved hydroenhancing equipment has a pair of manifolds 50*a,* 50*b* coupled by spring elements 54 that are oscillated to simulate multiple passes on one side of the fabric 12 conveyed in the machine direction MD on a conveyor 52. The manifolds are arranged to oscillate 180° in opposite phase (toward and away from each other) in order to alternately store and use mutual oscillation energy. The spring elements are selected to have a spring constant for the desired frequency and amplitude of oscillation. In this way, the driving energy needed to maintain the manifolds in oscillation will be minimized. The two manifolds are arranged to extend across the full fabric width FW in order to eliminate any edge effects that might occur with the oscillation movements. The manifolds are also arranged to oscillate diagonally at an angle to the fabric travel direction (MD) to eliminate interference patterns.

Oscillation of the manifolds can be obtained with similar parameters as a conventional needle loom, for example, one which oscillates at 20 Hertz with an amplitude of 2.4". The mass of the needle plate for the typical loom is less than the mass of the manifold, therefore the manifold would oscillate at a lower frequency, e.g., 6 Hertz. The combined manifolds simulate twice the number of passes on the fabric with each oscillation. Oscillating two manifolds on a diagonal at 6 Hertz with an amplitude of 2.4" provides the equivalent of 5 passes on fabric moving at a line speed of 48 fpm, or 24 passes on fabric moving at a line speed of 10 fpm. It is estimated that a production efficiency, in terms of yards of fabric per year per dollar of equipment cost, of four times that of conventional hydroenhancing equipment with multiple manifolds can be achieved with the oscillating manifolds arrangement.

A full-width diagonal manifold oriented at 45° across the fabric would not necessarily require a jet density of the usual 60 jets/inch. The 45° angle enables a 43 jets/inch jet strip in the manifold to have the same effective jet density as a 60 jets/inch jet strip aligned to trace in parallel with the MD. On the other hand, a 60 jets/inch jet strip at 45° angle would have the same effective jet density as an 85 jets/inch jet strip aligned with the MD. The increase in effective jet density in the latter case would also contribute to the elimination of interference effects. As an example, the total energy delivered by two diagonal manifolds operating at 1500 psi equipped with a 43 jets/inch jet strip with 0.005" holes enhancing a 200 gm/yd$^2$ fabric at a mean process speed of 24 fpm is 0.326 hp-hr/lb.

To treat both sides, the fabric after a first run under both manifolds is either flipped over for enhancing the other side in a second run, or a second enhancing stage can be provided downstream of the first stage for treating the other side in one process run. Providing a second enhancing stage would increase the cost of the equipment, but would facilitate continuous processing of fabric.

Figure 9:
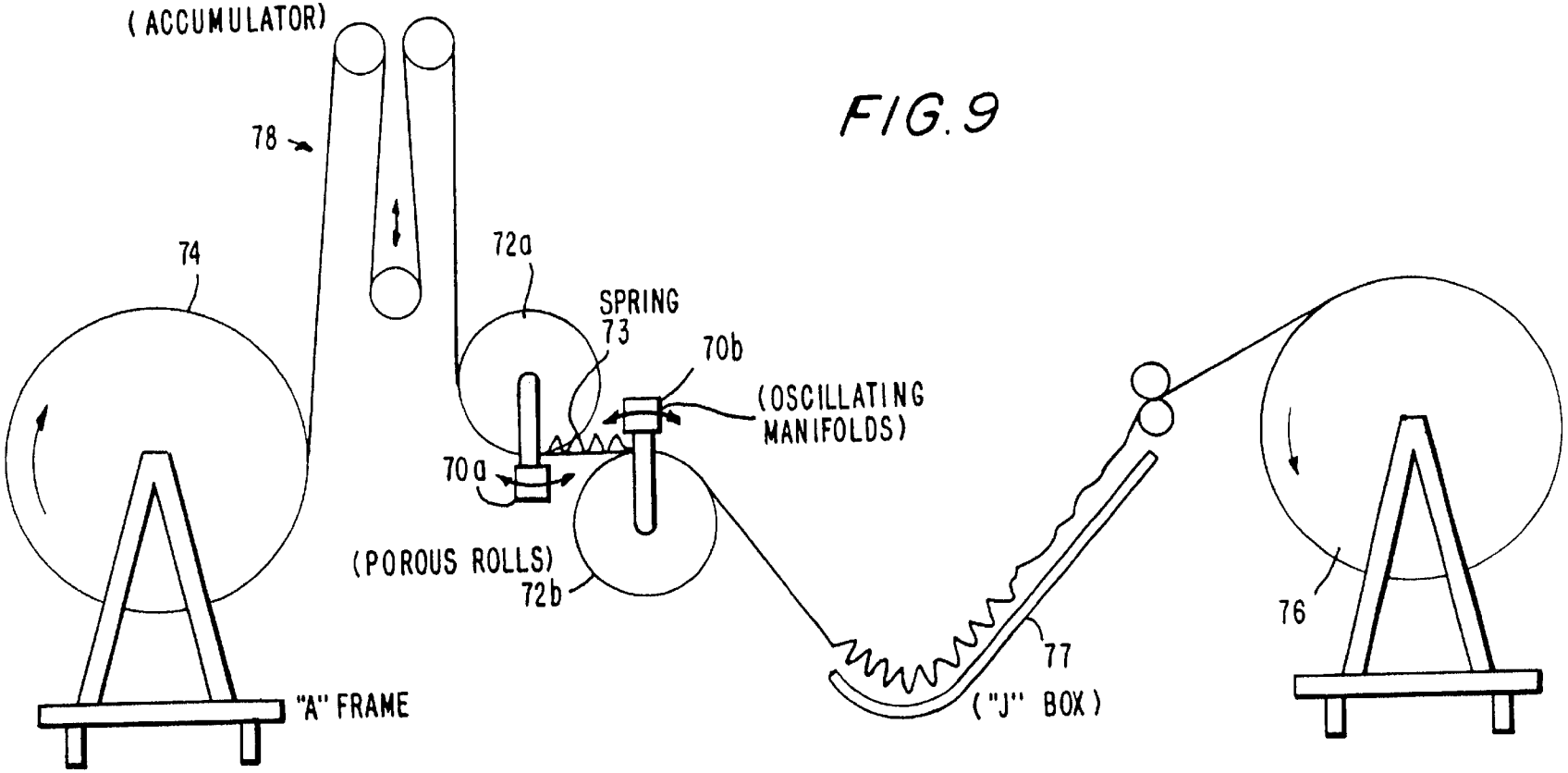
FIG. 9 shows a further version of improved hydroenhancing equipment employing a pair of oscillating manifolds on opposite sides of the fabric for simulating multiple passes on the fabric.

FIG. 9 shows another version of an oscillating manifold system for simulating multiple passes for fabric enhancement with a minimum of equipment cost. A pair of oscillating manifolds 70*a,* 70*b* are arranged to jet fluid streams onto the opposite sides of the moving fabric 12 which is entrained around respective porous drums 72*a,* 72*b* and driven from unwind reel 76 to windup reel 74. The manifolds, which are arranged across the fabric, are coupled by a spring element 73 and are mutually oscillated in opposite phase (toward and away) from each other to simulate multiple passes on the fabric, while also conserving oscillation energy. The fabric is enhanced in incremental lengths advanced to the manifold station and treated during a given time period for a prescribed number of manifold oscillations. A "J" box 77 from the unwind reel 76 and an accumulator 78 to the windup reel 74 are provided for dispensing and accumulating fabric with each incremental advance as the reels are driven continuously.

With this oscillating, opposite-side manifolds arrangement, both sides of the fabric can be treated with multiple simulated passes in one process run. A two-manifold machine of this type can be configured to enhance fabric at 0.25 hp-hr/lb total delivered energy in 12 simulated passes at a mean process speed of 30 ft/min. With this version, it is estimated that a production efficiency 20% greater than even the previously described jigged-transport system can be obtained.

IV. Rotating Multi-Strip Manifold

A further version of improved hydroenhancing equipment having a low equipment cost employs a rotating multi-strip manifold for simulating multiple passes on fabric. Referring to FIG. 10, a plurality of jet strips 80 are spaced uniformly around the periphery of a rotating drum manifold 82. Each jet strip is comprised of a row of jet orifices supplied with high pressure fluid from a central plenum for emitting a curtain of fluid jets against the surface of the fabric. The fabric 12 is transported on a support screen 84 of an endless conveyor system circumferentially around the drum manifold 82. The drum manifold is rotated at a higher speed than the transport speed of the support screen 84, so that the jet curtains can impact on the fabric in overlapping swathes to simulate multiple passes. A second rotating drum manifold (not shown) may be arranged downstream for treating the other side of the fabric.

The number of passes simulated by the rotating drum manifold depends upon the number of jet strips and the relative speed and direction of drum speed to fabric transport speed. For example, a drum manifold having three jet strips rotated in the same direction at a surface velocity four times that of the fabric transport speed will simulate nine passes on the fabric (3 rotations per unit of travel×3 jet strips). Rotation of the drum manifold counter to the travel direction of the fabric will increase the number of simulated passes that the fabric will receive. For example, if the drum manifold rotates in the counter direction with a surface velocity four times that of the fabric transport speed, then the manifold will rotate five times per length of fabric travel to simulate 15 passes on the fabric.

Figure 13:
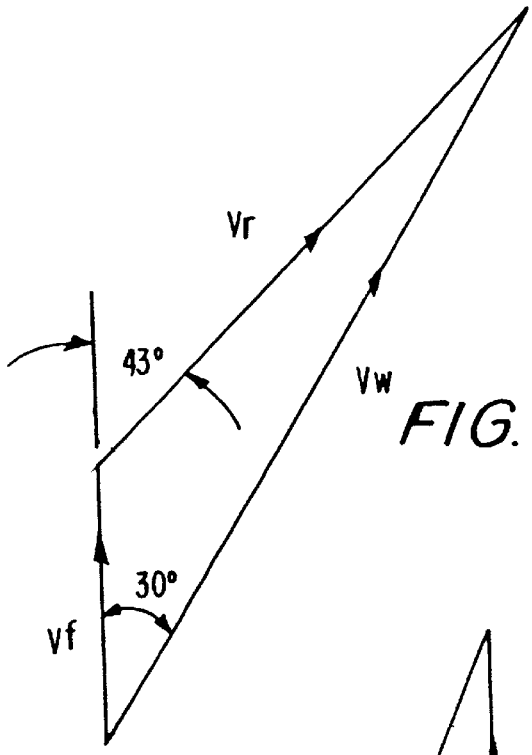
Figure 14:
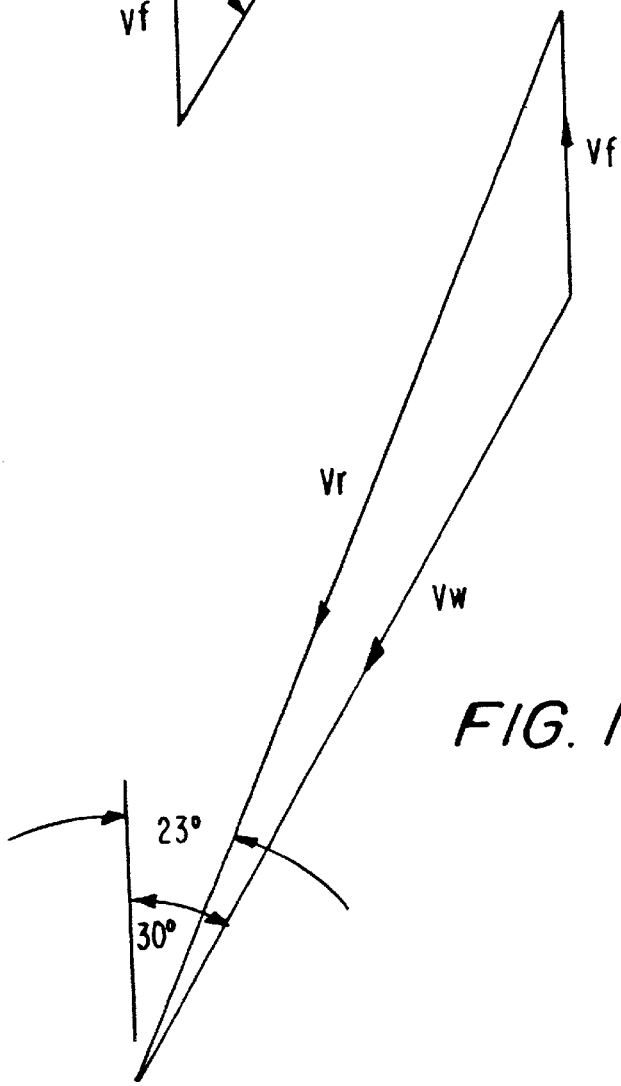

As illustrated in FIG. 12, the drum manifold may be arranged at an angle (30° indicated angle of the drum centerline CL) to the fabric travel direction, resulting in the jet curtains being continually displaced in the cross direction on each pass. This ensures that the jets of the drum manifold do not trace lines in the same positions on the fabric on each pass, thereby eliminating the interference effect (moire) with regular yarn spacings in the fabric. FIG. 13 shows an example of the effective velocity Vr of the jet curtain, having an effective angle of 43°, summed from the drum velocity Vw at a 30° angle in the same direction of the fabric travel velocity Vf. FIG. 14 shows the effective velocity Vr, having an effective angle of 23°, summed from the drum velocity Vw at a 30° angle in the opposite direction of the fabric velocity Vf. Rotating the drum manifold in the same direction as the fabric thus results in a greater angle of diagonal enhancing for avoiding interference patterns.

Figure 11:
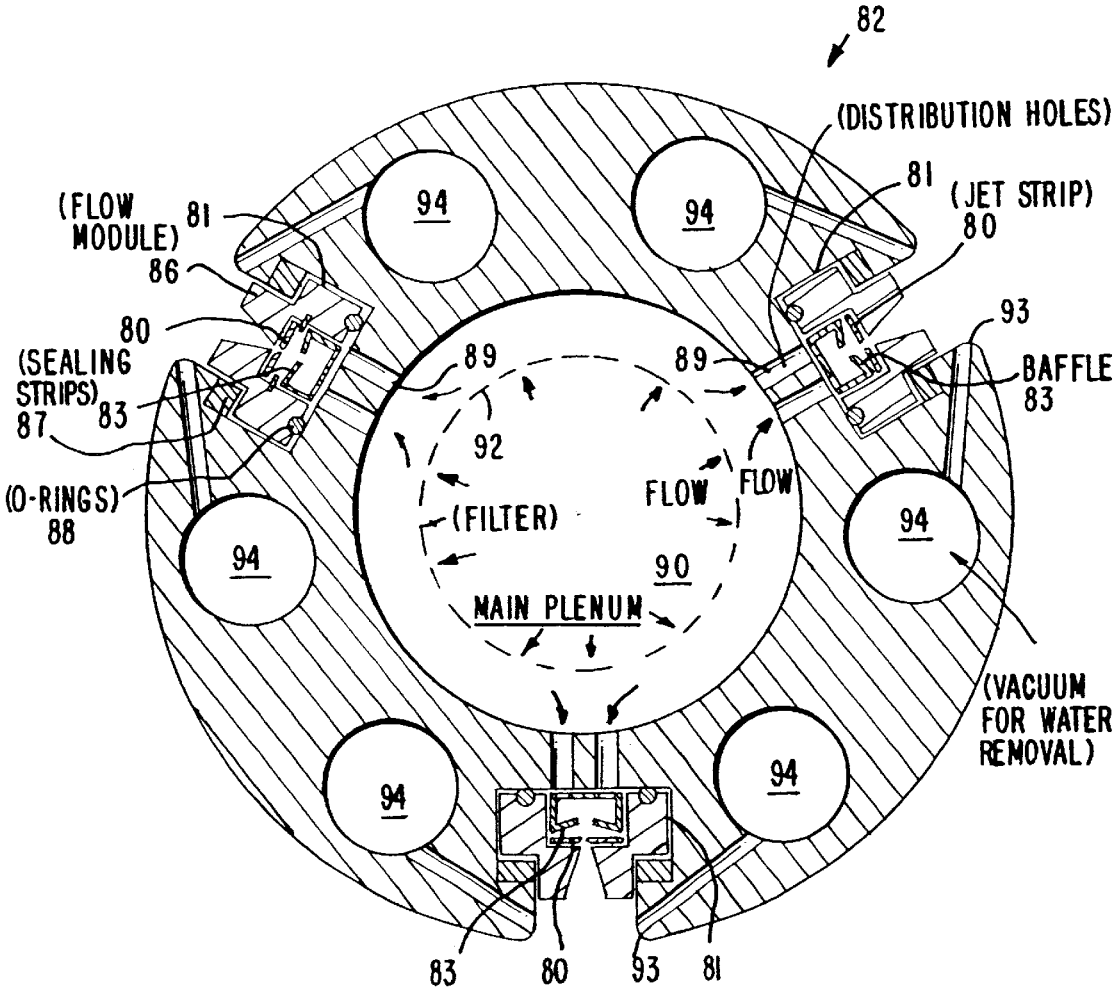
FIG. 11 is a detailed schematic view of the rotating multi-strip drum manifold for simulating multiple passes on the fabric.

Referring to the detailed view in FIG. 11, the rotating drum manifold preferably has jet strips 80 mounted in respective flow modules 86 that slide into correspondingly shaped module cavities 81 formed in the periphery of the drum manifold 82. Elongated O-rings 88 are placed in a closed-loop groove 93 in the top surface of the modules (see FIG. 15) to provide a seal around distribution holes 89 communicating from the main plenum 90 of the drum manifold to the inlet into each of the flow modules. High pressure water enters the main plenum 90 and flows through the plenum filter 92 to the flow modules 86 and then through the jet strips 80 to form the jet curtains used for fabric enhancing. A baffle structure 83 is provided in the interior plenum for creating a turbulent flow to the jet orifices in accordance with another aspect of the invention (described further below).

In FIG. 11, the jet discharge area of the flow modules may employ low pressure or negative air pressure for suctioning off water impacted on the fabric. An alternate arrangement is to generate an air pressure of 1 psi that would produce the same differential pressure as a vacuum box on the opposite side of the fabric with a 1 psi vacuum. Ports 93 with openings in the discharge area of the jet orifices can either communicate with vacuum chambers 94 for the removal of water or with low positive pressure to blow the excess water through the fabric. The incorporation of water removal with the jet manifold structure would further reduce the overall equipment size and cost.

Figure 15:
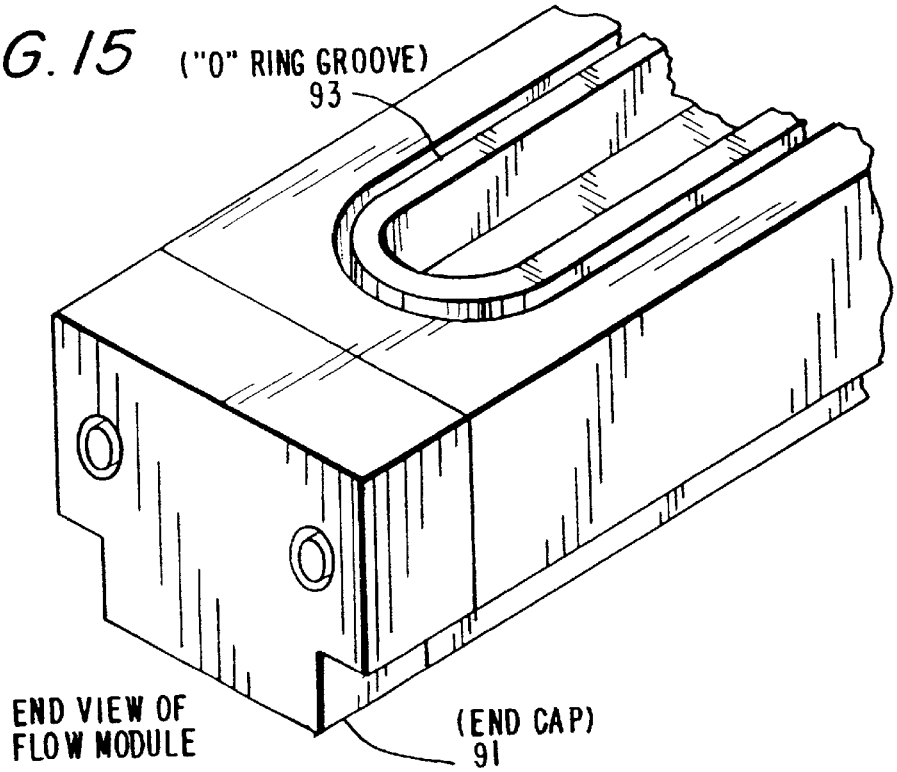
FIG. 15 is a perspective view of a flow module for the rotating multi-strip drum manifold of FIG. 10.
Figure 16:
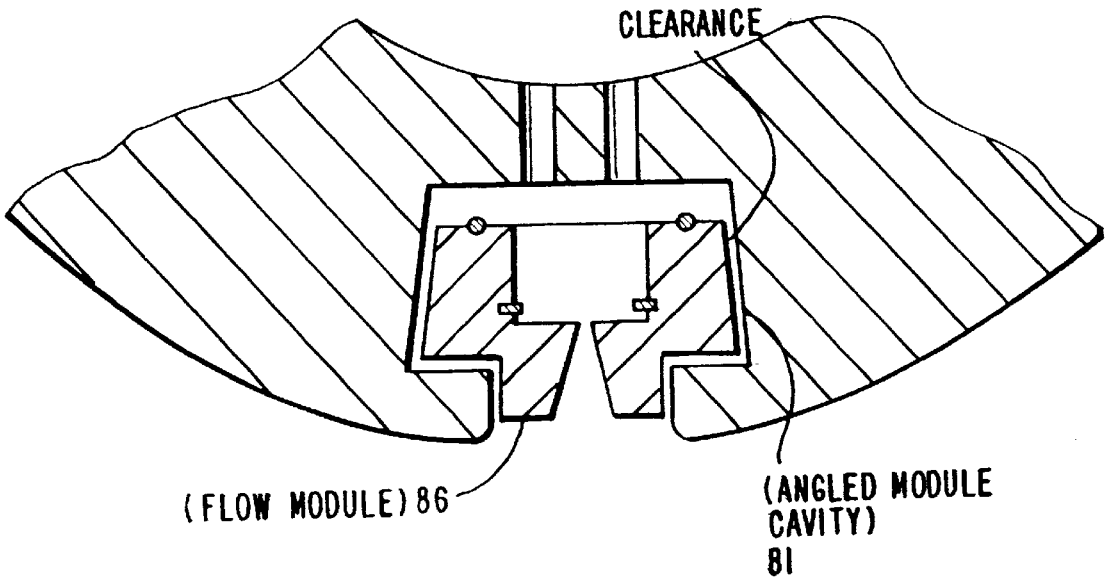
FIG. 16 is a cross-sectional view of the flow module inserted in the rotating multi-strip drum manifold of FIG. 10.

Clearance is provided between the flow module and the cavity walls so that the O-ring does not drag excessively along the top surface of the cavity 81 upon insertion. The walls of the module 86 and the cavity 81 are correspondingly angled to properly seat the module and seal it against the cavity walls, as shown in FIG. 16. Rigid sealing strips 87 are forcibly inserted between the lower rails of the cavity 81 and the lower surface of the inserted module in order to take up the clearance space for tightly fitting the flow module in the cavity and pressing the O-ring into contact with the top surface of the cavity. The sealing strips 87 also seal the cavity from the lower discharge area of the flow module. An end cap 91, shown in FIG. 15, is provided at one axial end of the flow module 86 to facilitate replacement of the jet strip 80 without having to remove the flow module from the drum manifold.

The close tolerances of the cavity 81 and the angled sides of the flow module 86 can be fabricated using a specially designed broach. The cavity is first machined out until close to the final dimensions. The broach is then forced along the cavity to remove the final material, achieving the angled sides in the process. The top surface which provides the O-ring seal is smoothly finished with grinding. This design for the flow module allows the module components to be assembled and the module to be held in the drum manifold by friction or interference fit without any bolts, thereby lowering machining costs considerably.

V. Low-Energy, Multiple-Pass Method On Conventional Equipment

Figure 2:
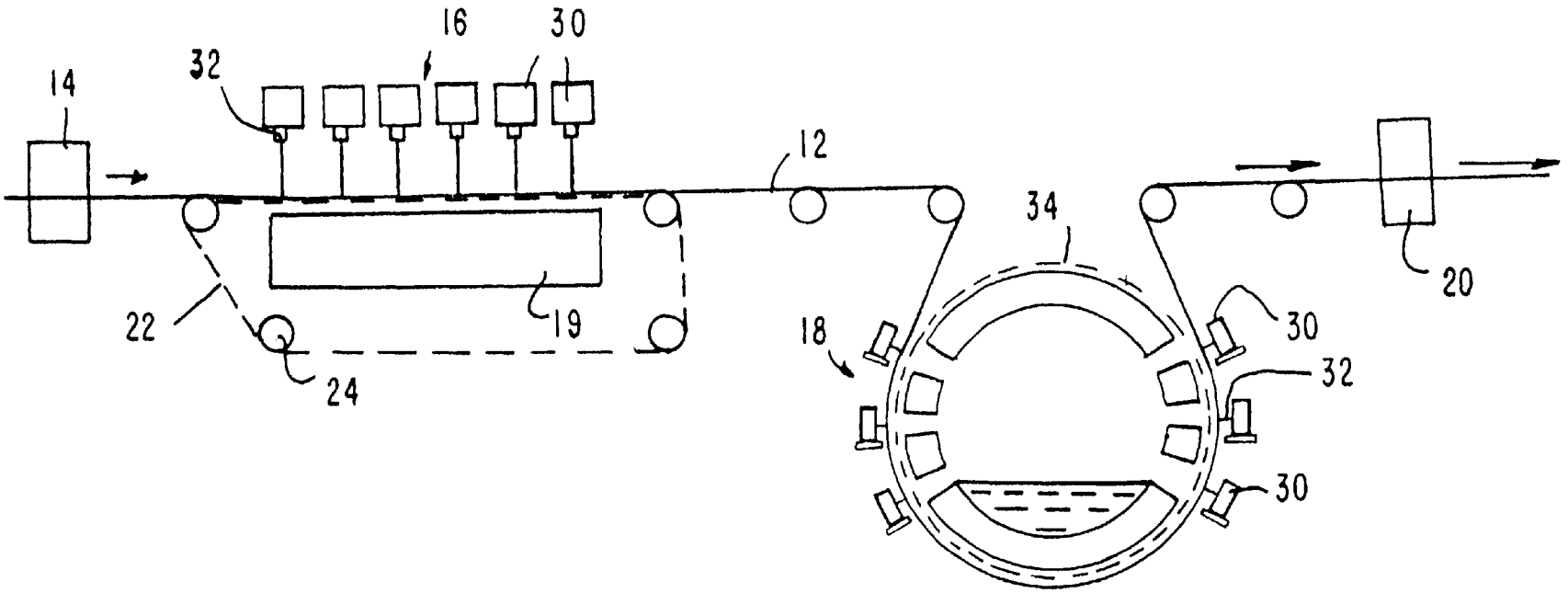
FIG. 2 (PRIOR ART)
FIG. 2 is a schematic illustration of a conventional hydroenhancing line for enhancing the surface properties of fabric by hydrojet treatment.

The low-energy-per-pass, multiple-pass method can also be implemented with conventional hydroenhancing equipment, such as illustrated in FIG. 2, by increasing the process (line) speed to attenuate the energy delivered to the fabric per pass and processing the fabric in multiple passes by using a sufficient number of manifolds and/or number of runs.

Figure 1:
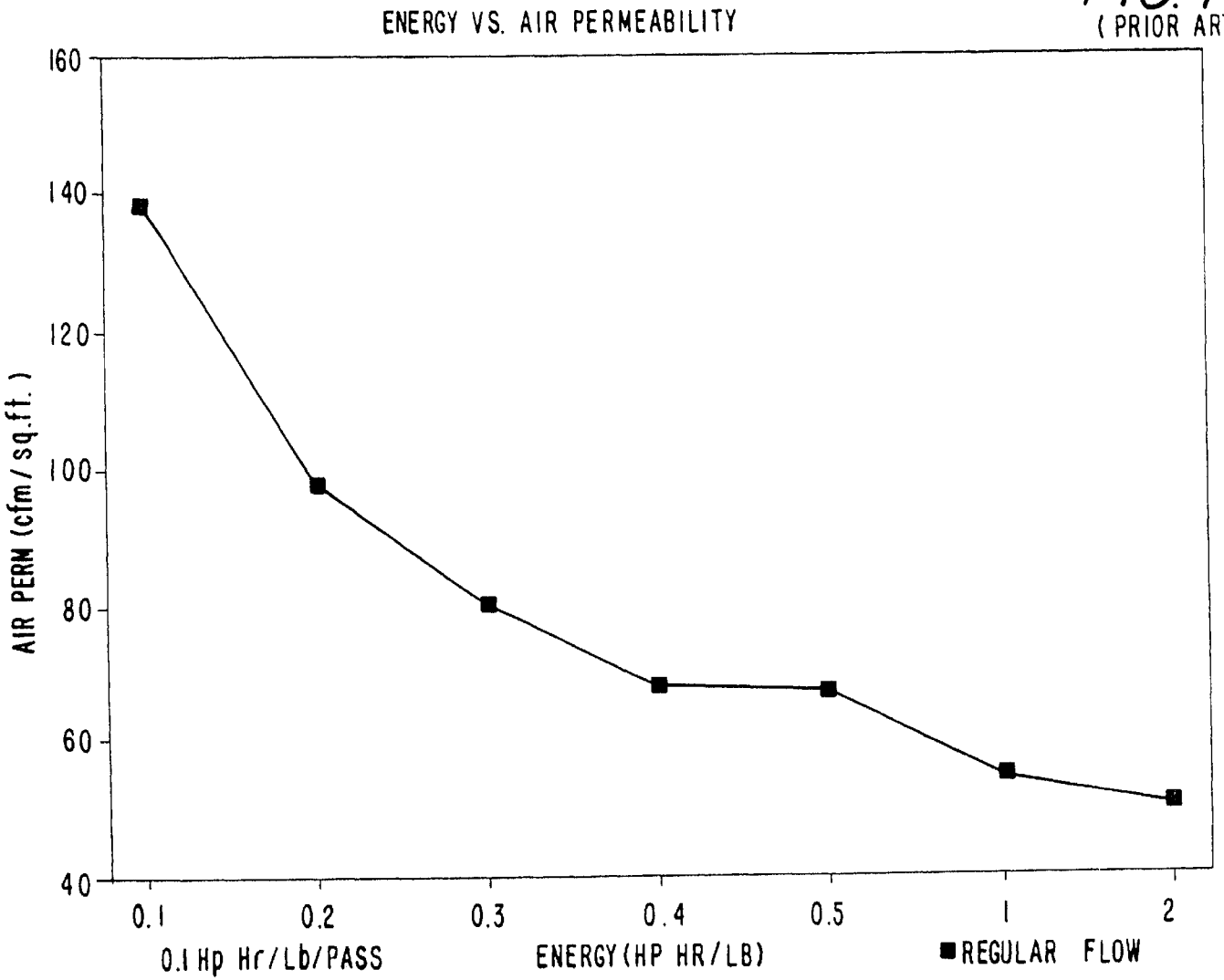
FIG. 1 (PRIOR ART)
FIG. 1 illustrates relationship as known conventionally between energy expended in hydrotreatment and the resulting coverage (measured in terms of air permeability) of the fabric.

With conventional hydroenhancing equipment, a line speed of up to 500 ft/min or higher may be used. The jet orifices may have diameters in the range of from 0.005 to 0.010 inches and center-to-center spacings of from 0.017 to 0.034 inches. The manifolds may supply jets with pressures in the range of from 200 to 3,000 psi. Enhancement may be obtained with a total delivered energy from 0.1 hp-hr/lb to 2.0 hp-hr/lb. A processing line may have one, two, four, six or more manifolds arranged in series. A typical configuration might employ two or four manifolds, with jets of 0.005 inch orifice diameter spaced 0.017 inch apart (60 jets/inch), fluid pressure of 1500 psi, line speed of about 30 fpm, and total delivered energy of 0.46 hp-hr/lb. As shown in FIG. 1, treatment by conventional hydroenhancement equipment of spun yarn fabric at delivered energies ranging from 0.1 to 2.0 hp-hr/lb per weight of fabric results in fabric coverage (as measured in terms of air permeability) of from 140 to 50 cfm/ft$^2$.

The low-energy-per-pass, multiple-pass method implemented with conventional hydroenhancing equipment can obtain significantly more efficient utilization of delivered energy as enhancement energy. The test results summarized on Table I were conducted on a fabric referred to in the industry as Samuelson PFP Classic Style, made of polyester spun yarn having a basis weight of 158 gm/yd$^2$ (gsy). It was treated with conventional hydroenhancing equipment having two manifolds, each with 60 orifices/inch of 0.005 diameter, and fluid pressure at 1500 psi. The total energy delivered from both manifolds was varied in different trials over a range from 0.125, 0.250, 0.50, to 1.0 hp-hr/lb (half this amount per manifold). The energy delivered to the fabric per pass was reduced to a fraction of the manifold energy level by increasing the line speed from 10 fpm on up to 488 fpm, and the number of passes was increased in increments from 2 passes to 100 passes. The fabric was treated with an equal number of passes per side. The weight (in grams and ounces), thickness (in mils), air permeability (in cfm/ft$^2$), warp shrinkage and weft shrinkage (in percent) of the resulting fabric were measured.

Figure 18:
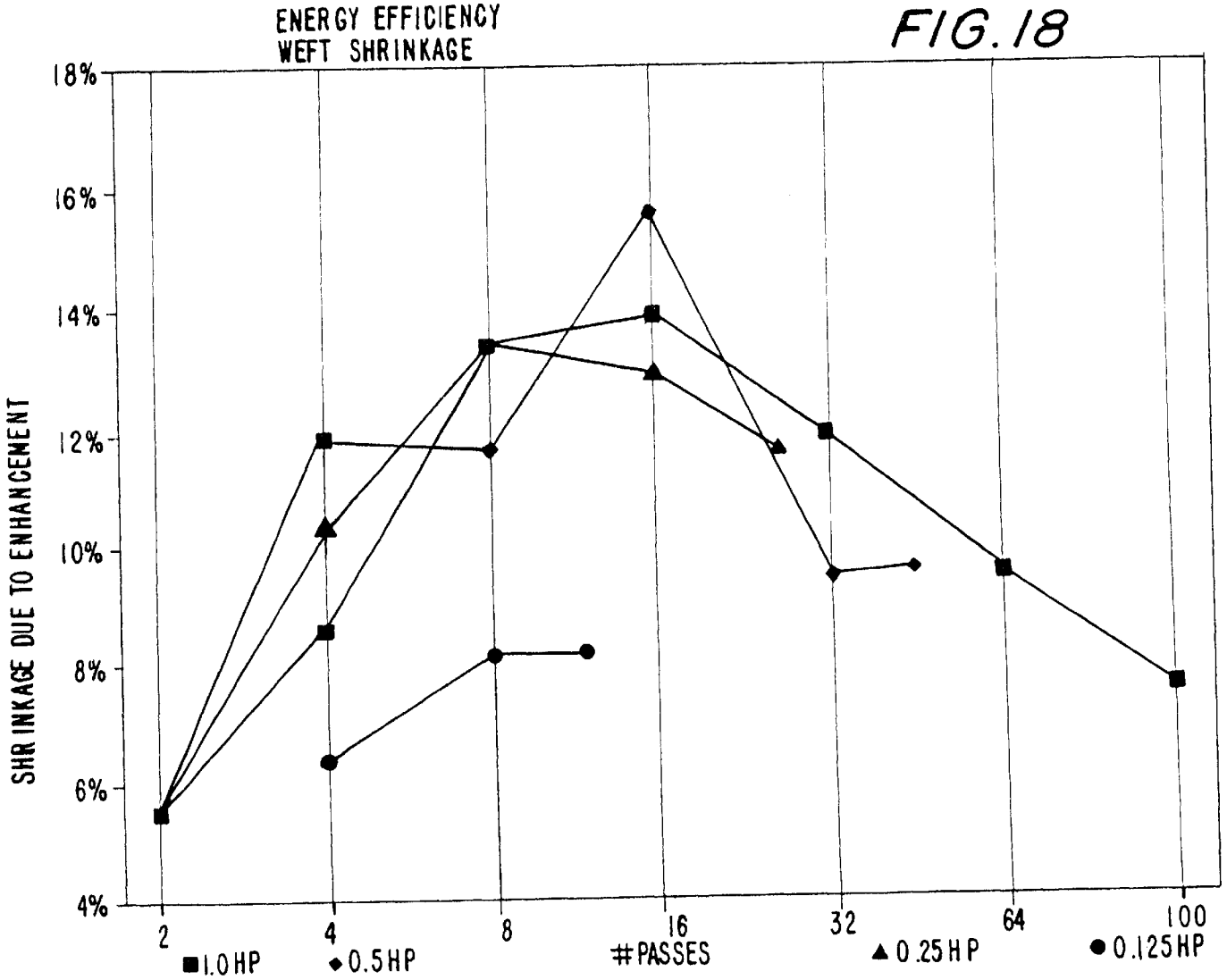
FIG. 18 is a graph of air permeability versus number of passes for different levels of total energy delivered, using the low-delivered-energy, multiple-pass method of the present invention.

Based upon the quantitative results of Table I, the graph in FIG. 18 shows the relationship between air permeability versus number of passes at different manifold energy levels. The graph shows that, at any given manifold energy level, there is a marked decrease in air permeability (corresponding to increase in fabric coverage) as the energy delivered to the fabric per pass was lowered (by increased line speed) and the number of passes was increased. For example, for a manifold energy level of 1.0 hp-hr/lb, air permeability was reduced from about 90 cfm/yd$^2$ obtained in two passes (at 10 fpm) to about 45 cfm/yd$^2$ obtained in 16 passes (at 77 fpm). For fabric treated with a manifold energy at 0.25 hp-hr/lb, air permeability was reduced from about 94 cfm/yd$^2$ obtained in two passes (at 38 fpm) to about 57 cfm/yd$^2$ obtained in 32 passes (at 488 fpm). The graph shows that air permeability increased slightly for 32 passes at 0.5 hp-hr/lb and 64 passes at 1.0 hp-hr/lb. Due to the high speed of the passes creating anomalous results, the tests were repeated with correction for possible screen shifting, and the repeat results showed that air permeability at the higher number of passes was reduced to or below the level at 16 passes, as was expected.

A further comparison was made of the fabric treated at different manifold energy levels. A fabric enhanced at a manifold energy level of 0.25 hp-hr/lb using 24 passes at 488 fpm was visually inspected and found to be superior in surface cover compared to fabric enhanced at a manifold energy level of 1.0 hp-hr/lb using 2 passes at 10 fpm. Similarly, a fabric enhanced at a manifold energy level of 0.125 hp-hr/lb using 12 passes at 488 fpm was superior to a fabric enhanced at a manifold energy level of 1.0 hp-hr/lb using 2 passes at 10 fpm. The air permeability results shown in the graph of FIG. 18 confirm these observations.

In a conventional process, the energy delivered to the fabric per pass at a manifold energy level of 1.0 hp-hr/lb in 2 passes at 10 fpm line speed is 0.5 hp-hr/lb/pass. In the invention process, the energy delivered to the fabric per pass at a manifold energy level of 0.125 hp-hr/lb using 12 passes at 488 fpm line speed is 0.0104 hp-hr/lb/pass. Therefore, for comparable enhancement results obtained, the energy per pass at 1.0 hp-hr/lb in the conventional process is 48 times greater than the energy per pass at 0.125 hp-hr/lb in the invention process. These results indicate that the low-delivered-energy, multiple-pass method of the invention enables more of the delivered energy to be converted into enhancement energy to obtain a comparable or better product, as compared to conventional hydroenhancing methods using higher levels of delivered energy to the fabric in fewer passes.

The above-described tests also show that a comparable enhancement result (measured in terms of air permeability) was obtained in the invention using ⅛ the manifold energy level as compared to the conventional process. It can be surmised that using a high level of manifold energy, as practiced conventionally, results in a large proportion of it being wasted and only a little being converted into enhancement energy. For example, the graph in FIG. 18 shows that the air permeability results for treatment with 1.0 and 0.5 hp-hr/lb total energy delivered were similar, therefore at least half of the total energy delivered at 1.0 hp-hr/lb was wasted. Also, the air permeability results for the 0.25 hp-hr/lb energy level at 24 passes is only slightly more than the air permeability results for the 0.5 and 1.0 hp-hr/lb energy levels at the same number of passes. Generally, the highest hydroenhancing efficiency (least energy wasted) for comparable enhancement results was obtained at lower manifold energies of 0.25 to 0.125 hp-hr/lb (0.125 to 0.0625 hp-hr/lb per manifold) in 16 passes or higher.

Figure 19A:
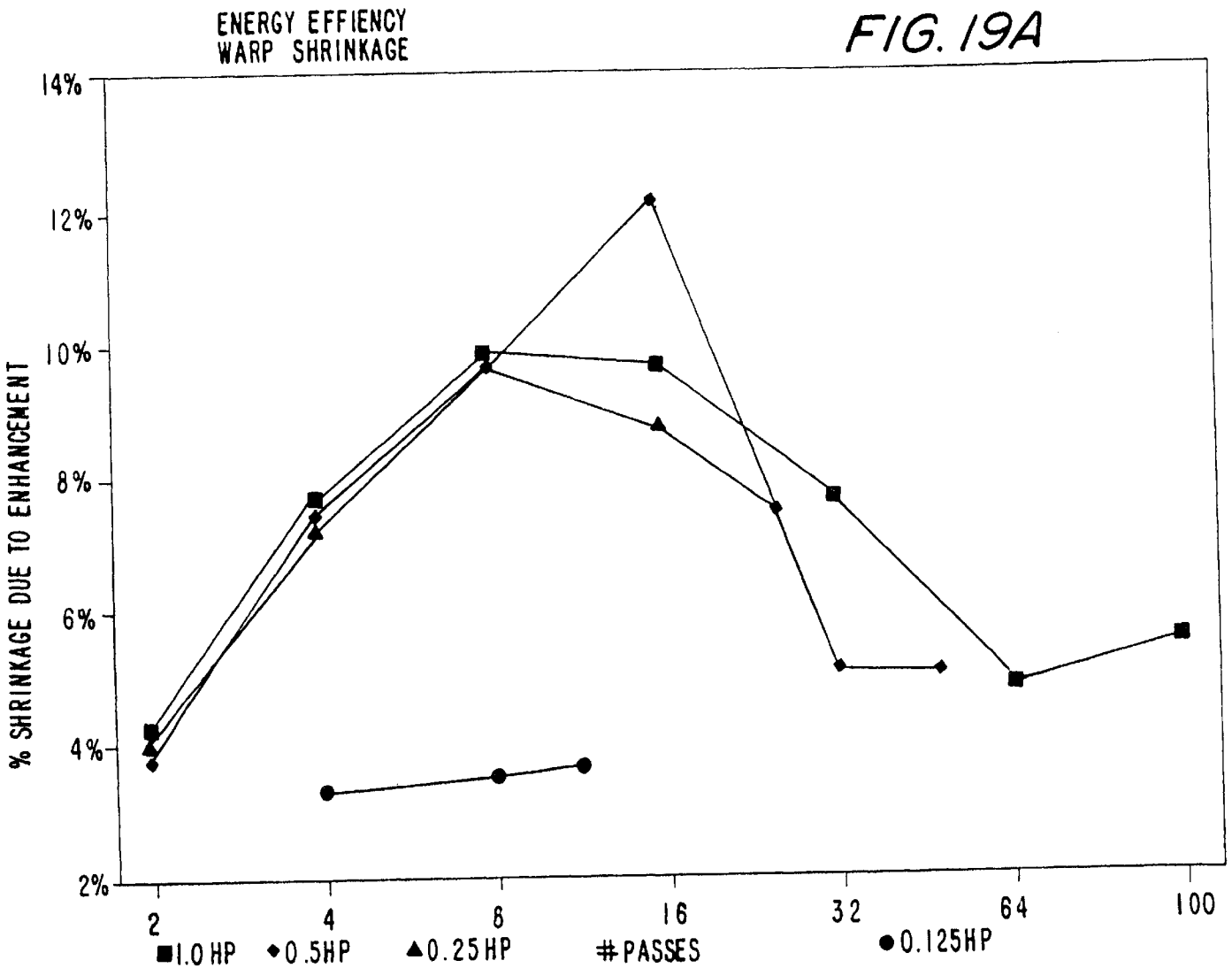
FIGS. 19A, 19B are graphs of warp and weft shrinkage (in percentages) versus number of passes at different levels of total delivered energy, using the low-delivered-energy, multiple-pass method of the present invention.
Figure 19B:
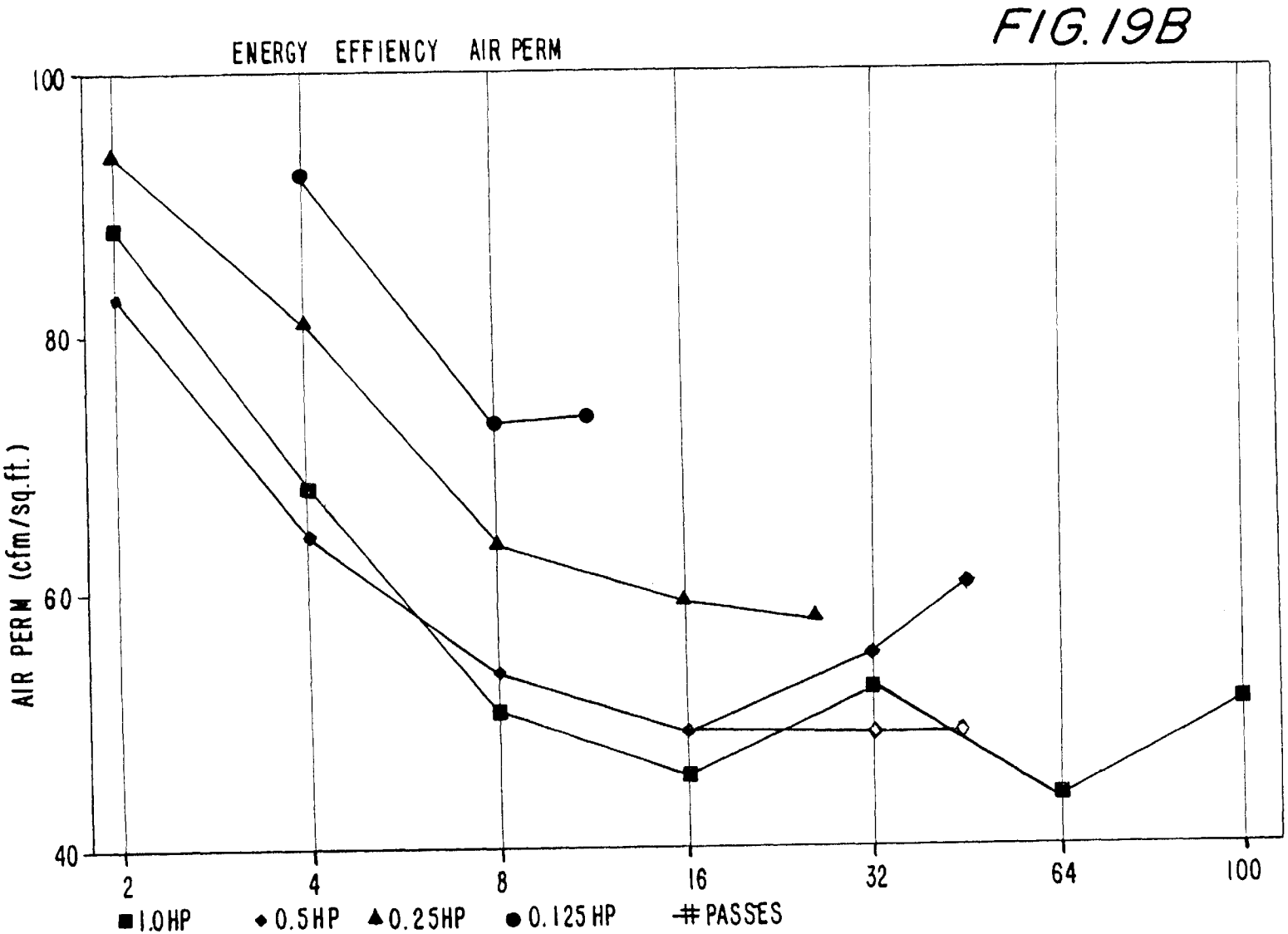

A surprising result of the invention method was an unexpected reduction in fabric shrinkage. A certain amount of shrinkage is normally associated with fabric enhancement. It is theorized that the blooming of the yarns under fluid impact causes the paths of the fibers in the yarns to change, which in turn causes the yarns overall to shrink. The graphs in FIGS. 19A and 19B show the percent of warp (machine direction) and weft (cross direction) shrinkage obtained versus the number of passes at different levels of total delivered energy. The graphs show that fabric shrinkage increases initially and reaches a peak at about 16 passes then decreases significantly. The reduction in shrinkage at the higher numbers of passes may be due to straightening of the fiber paths under repeated impacts. Shrinkage at a lower total energy level of 0.125 hp-hr/lb was significantly lower overall than at higher energy levels. Reduced shrinkage in the weft direction is advantageous in that it requires less tentering after enhancing, since tentering stretches the yarn and reduces the level of bloom.

VI. Improved Coverage, Reduced Shrinkage, Elimination of Moire

As a further aspect of the invention, it is found that improvements in fabric coverage (measured in terms of lower air permeability), reduced shrinkage, and elimination of interference (moire) patterns are obtained by providing jet streams from a manifold with a constantly fluctuating cross-sectional shape. It is theorized that the situs of jet impact on the fabric results in the movable fibers in that area being immediately displaced, but the impact situs must be moved to a new position to make contact with other movable fibers to make use of the subsequently delivered. energy. Fluctuation or oscillation of the jet cross-sectional shape constantly changes the situs of jet impact over more fibers so that more of the manifold delivered energy is used as fabric enhancement energy.

In accordance with this aspect of the invention, the manifold in any of the systems described above can be modified to produce jets of constantly fluctuating cross-sectional shape, in order to distribute the delivered energy of the jets over a broader impact area for improved enhancement results. Regular jet flow is generally columnar and may have only slow fluctuations in shape over time. Constant fluctuations in the cross-sectional shape of the jets can be generated by placing a baffle 83 in the interior of the flow module below the inlet holes and in close proximity to the jet strip, as shown in FIG. 11, so as to induce turbulence which causes fluctuations in the jet streams emitted from the manifold. The baffle can have any type of design which is effective in inducing turbulence to cause fluctuations in the jet streams. One type of design is shown in FIG. 11 consisting of a metal plate bent to form a rigid channel shape with a central constriction for the flow of fluid from the inlet to the jet orifices.

The turbulence induced by the baffle in the fluid flow in the manifold results in random disturbance to the jets emitted from the jet orifices so that they form randomly spiraling ribbons that oscillate in cross-sectional shape, direction and structure. The spiraling ribbons distribute their impact energies over constantly changing impact areas on the fabric for improved enhancement and more efficient utilization of enhancement energy. The baffle may be used with conventional hydroenhancing equipment, as well as with the improved equipment previously describes. A more detailed explanation of this feature is provided in commonly owned U.S. Pat. No. 5,933,931, entitled "Turbulence-Induced Hydroenhancing for Improved Efficiency", which is incorporated herein by reference, Improved Efficiency", filed simultaneously herewith, which is incorporated herein by reference.

It is also found that fabrics enhanced with fluctuating jets exhibit considerably less shrinkage than fabrics enhanced using regular jet flow. Tests have shown that warp shrinkage can be reduced from a high of 10% to about 2%, and weft shrinkage from about 14% to about 6%. The reduction in shrinkage is found to occur at all energy levels. The constant fluctuation of the jets improves fabric enhancing even at low process speeds and a low number of passes.

The constant fluctuation of the jets also substantially reduces the generation of interference (moire) patterns in the fabric As indicated in FIG. 7, the regular spacing of jets aligned with the machine direction can interfere with the regular spacing of the warp yarns so as to generate repeating stripe patterns in the fabric. With jets of fluctuating cross-sectional shape, the impact area of the jets will be constantly moved over the yarn spacings, so that interference patterns are reduced or eliminated. As described previously, interference patterns can also be eliminated by orienting the manifold at an angle to the fabric travel direction.

Interference patterns can also be reduced by increasing the density of the jets relative to the warp yarn spacing. For example, interference patterns are produced by jets with a density of 40 jets/inch on a fabric having 60 warp-yarns/inch or more. The interference patterns can be eliminated by using a high jet density, e.g., 100–200 jets/inch. A jet density of 104 jets/inch was found to eliminate interference patterns for fabrics with warp yarn counts as fine as 98 ends/inch. For the higher jet densities, e.g., 120 jets/inch or more, it may be more convenient to use a double row of jets, i.e., two rows of 60 jets/inch, to avoid the high tolerances or machining required.

Another technique to eliminate moire can employ a row of orifices delivering fan jets to create a continuous water curtain, instead of orifices delivering jets in columnar streams, the manifold for example, as described in commonly-owned U.S. Pat. No. 4,995,151 of Siegel et al., issued on Feb. 26, 1991, entitled "Apparatus and Method For Hydropatterning Fabric", incorporated herein by reference. The larger diameter of the fan jets and simpler structure can further reduce equipment costs. The use of fan jets can avoid the generation of interference patterns since the overlapping fan jets tend to lessen or eliminate the tracing of lines on the fabric.

Figure 17:
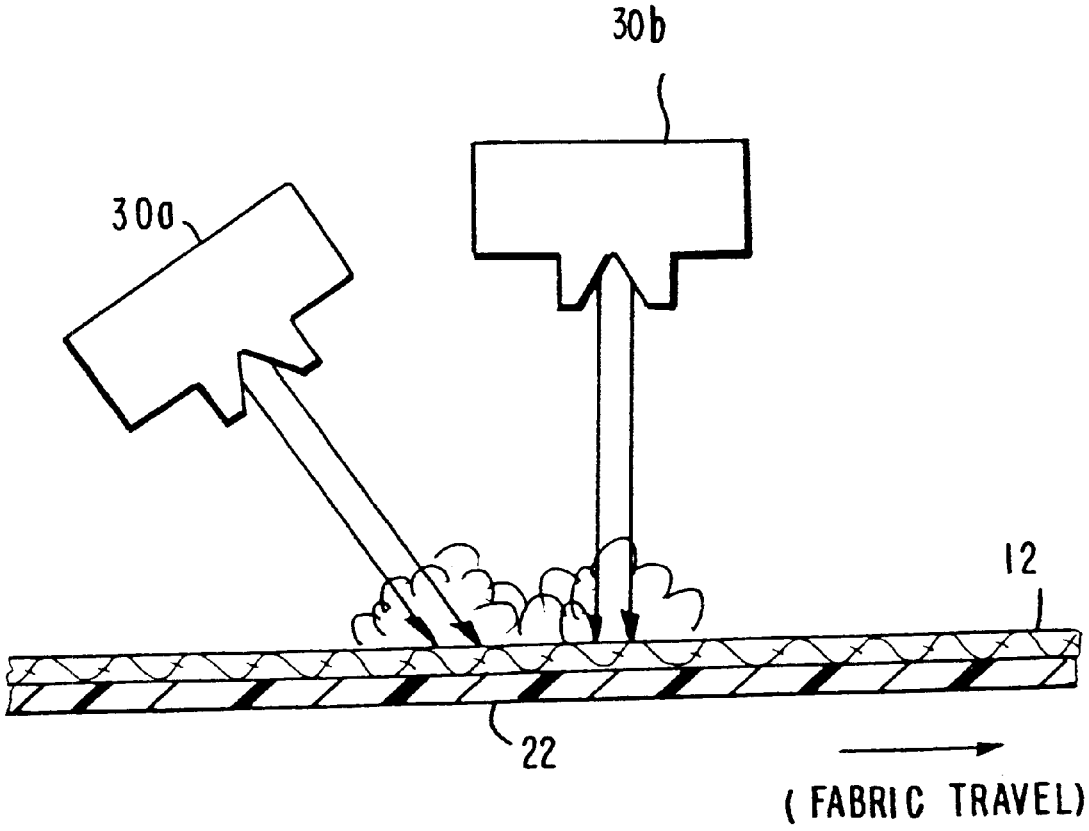
FIG. 17 is a schematic view of another embodiment of improved hydroenhancing equipment employing two manifolds combined together for improved hydroenhancement and fabric coverage.

Improved fabric coverage and elimination of interference patterns can also be obtained by using a combined manifold arrangement as shown in FIG. 17. With the fabric 12 moving in the fabric travel direction (arrow) on the support surface 22, a downstream manifold **30*b* having jets pointing straight downward on the fabric is employed in combination with an upstream manifold 30*a*** having jets canted at an angle (bias) toward the fabric travel direction. The straight water curtain impacts on the fabric holding the yarns in place while the bias curtain impinges at an angle to impact toward the impact zone of the downstream manifold for greater blooming of the yarns in the fabric. A dense spacing of jets or a double row of jets may also be used for eliminating interference patterns. For example, a double row of jets of 60 jets/inch density and 0.005 inch jet diameter in the upstream manifold canted at a 45° angle toward the fabric travel direction would have the effect of a jet density of 168 jets/inch in a conventional manifold, yielding extraordinary coverage. The manifolds may also be angled across the fabric width, as described previously. The combined-manifold configuration results in better coverage of the fabric and utilization of delivered energy. It may be used with conventional hydroenhancing equipment, as well as with the improved equipment previously described.

It is understood that many modifications and variations may be devised given the above description of the principles of the invention. It is intended that all such modifications and variations be considered as within the spirit and scope of this invention, as defined in the following claims.

TABLE I

| | Control 12 1 93 | 8) 12 16 93 | 8) 12 09 93 | 9) 12 09 93 | 10) 12 09 93 | 11) 12 09 93 | 1) 12 21 93 | 2) 12 23 93 | 9) 12 16 93 |
|---|---|---|---|---|---|---|---|---|---|
| PSI | 0 | 1500 | 1500 | 1500 | 1500 | 1500 | 1500 | 1500 | 1500 |
| Hp Hr/Lb | 0 | 1 | 1 | 1.25 | 1 | 1 | 1 | 1 | 0.5 |
| Passes | 0 | 2 | 4 | 8 | 16 | 32 | 64 | 100 | 2 |
| Speed | 0 | 10 | 19 | 31 | 77 | 154 | 308 | 488 | 19 |
| Baffle | 0 | R | R | R | R | R | R | R | R |
| Weight (gsy) | 157.62 | 170.34 | 180.36 | 194.38 | 194.84 | 182.86 | 167.02 | 173.02 | 172.28 |
| Weight (osy) | 5.56 | 6.01 | 6.36 | 6.86 | 6.87 | 6.45 | 5.89 | 6.10 | 6.08 |
| Thickness (mils) | 34.1 | 33.5 | 32.7 | 33.8 | 34.6 | 33.7 | 31.7 | 30.5 | 33.5 |
| Air Perm (cfm/sq ft) | 261 | 88 | 68.00 | 50.74 | 45.58 | 52.19 | 63.83 | 51.15 | 83 |
| WARP Shrinkage due to enhancement | | 4.16% | 7.66% | 9.85% | 9.63% | 7.66% | 4.81% | 5.47% | 3.72% |
| WEFT Shrinkage | | 5.47% | 8.53% | 13.35% | 13.79% | 11.82% | 9.41% | 7.44% | 5.47% |

| | 12) 12 01 93 | 13) 12 09 93 | 14) 12 09 93 | 15) 12 09 93 | 3) 12 23 93 | 10) 12 16 93 | 16) 12 09 93 | 17) 12 09 93 | 18) 12 01 93 |
|---|---|---|---|---|---|---|---|---|---|
| PSI | 1500 | 1500 | 1500 | 1500 | 1500 | 1500 | 1500 | 1500 | 1500 |
| Hp Hr/Lb | 0.625 | 0.5 | 0.5 | 0.5 | 0.5 | 0.25 | 0.25 | 0.25 | 0.25 |
| Passes | 4 | 8 | 16 | 32 | 50 | 2 | 4 | 8 | 16 |
| Speed | 31 | 77 | 154 | 308 | 488 | 38 | 77 | 154 | 308 |
| Baffle | R | R | R | R | R | R | R | R | R |
| Weight (gsy) | 191.47 | 197.23 | 196.47 | 180.13 | 173.05 | 170.01 | 177.15 | 188.27 | 181.57 |
| Weight (osy) | 6.75 | 6.96 | 6.93 | 6.35 | 6.10 | 6.00 | 6.25 | 6.64 | 6.40 |
| Thickness (mils) | 33.5 | 33.5 | 33.5 | 33.7 | 31.3 | 33.5 | 33.1 | 33.6 | 32.8 |
| Air Perm (cfm/sq ft) | 64.12 | 53.44 | 48.99 | 54.91 | 60.61 | 94 | 81.00 | 63.76 | 59.22 |
| WARP Shrinkage due to enhancement | 7.44% | 9.63% | 12.04% | 5.03% | 5.03% | 3.94% | 7.22% | 9.63% | 8.75% |
| WEFT Shrinkage | 11.82% | 11.60% | 15.54% | 9.41% | 9.63% | 5.47% | 10.28% | 13.35% | 12.91% |

| | 19) 12 09 93 | 19) 12 23 93 | 20) 12 23 93 | 21) 12 23 93 | REPEAT 18) 2 17 94 | REPEAT 19) 2 17 94 | REPEAT 20) 2 17 94 |
|---|---|---|---|---|---|---|---|
| PSI | 1500 | 1500 | 1500 | 1500 | 1500 | 1500 | 1500 |
| Hp Hr/Lb | 0.25 | 0.125 | 0.125 | 0.125 | 1 | 0.5 | 0.5 |
| Passes | 32 | 4 | 8 | 12 | 64 | 50 | 32 |
| Speed | 488 | 154 | 308 | 488 | 308 | 488 | 308 |
| Baffle | R | R | R | R | R | R | R |
| Weight (gsy) | 181.63 | 171.72 | 174.52 | 171.87 | 181.22 | 177.06 | 179.54 |
| Weight (osy) | 6.41 | 6.06 | 6.16 | 6.06 | 6.39 | 6.25 | 6.33 |
| Thickness (mils) | 33.3 | 32.4 | 32.3 | 32.2 | 32.5 | 31.2 | 32.4 |
| Air Perm (cfm/sq ft) | 57.32 | 92 | 73 | 74 | 44.54 | 49.09 | 48.95 |
| WARP Shrinkage due to enhancement | 7.44% | 3.28% | 3.50% | 3.72% | 4.16% | 3.72% | 4.16% |
| WEFT Shrinkage | 11.60% | 6.35% | 8.10% | 8.10% | 10.72% | 9.85% | 9.63% |

We claim:

1. Equipment for hydroenhancing and finishing non-woven and knit fabric, including spun and/or spun filament yarn, comprising:

a manifold having a row of jet orifices which emit a curtain of fluid jets at a given level of total delivered energy per weight of fabric;

transport means for transporting the fabric in a travel direction at a given speed relative to the manifold so that the curtain of fluid jets impacts on the fabric;

wherein the manifold is operated in movement relative to the transporting of the fabric such that the curtain of fluid jets is delivered to the fabric at a low energy per pass which is a selected fraction of the given level of total delivered energy and in a high number of passes on the fabric which is a multiple corresponding to the selected fraction, whereby an improved conversion of delivered energy to enhancement energy is obtained on each pass and waste of energy is reduced, wherein the manifold is a drum manifold having a plurality of jet strips with respective rows of jet orifices mounted around the periphery thereof, said drum manifold being rotated to apply the fluid curtains from the plurality of jet strips in overlapping swathes to simulate multiple passes on the fabric.

2. Equipment according to claim 1, wherein the drum manifold is arranged at a diagonal angle to the fabric travel direction to eliminate the generation of interference patterns in the fabric.

3. Equipment according to claim 1, wherein the drum manifold has three jet strips mounted thereon and is rotated to have a surface velocity in the fabric travel direction at four times the speed of fabric transport so as to simulate nine passes over the fabric in a process run.

4. Equipment according to claim 1, wherein the drum manifold is rotated to have a surface velocity opposite to the fabric travel direction at four times the speed of fabric transport so as to simulate 15 passes over the fabric in a process run.

5. Equipment according to claim 4, wherein the drum manifold is rotated to have a surface velocity opposite to the fabric travel direction at four times the speed of fabric transport so as to simulate 15 passes over the fabric in a process run.

6. An improved method of hydroenhancing and finishing woven and knit fabric, including spun and/or spun filament yarn using a manifold having a row of jet orifices which emit a curtain of fluid jets at a given level of total delivered energy per weight of fabric to impact on a side of the fabric as it is transported in a travel direction at a given speed relative to the manifold, wherein the improvement comprises operating the manifold in movement relative to the transporting of the fabric such that the curtain of fluid jets delivers a low energy to the fabric per pass which is a selected fraction of the given level of total delivered energy and in a high number of passes over the fabric which is a multiple corresponding to the selected fraction, whereby an improved conversion of delivered energy to enhancement energy is obtained on each pass and waste of energy is reduced, wherein the manifold is a drum manifold having a plurality of jet strips mounted thereto and is rotated to apply jet curtains in overlapping swathes to simulate multiple passes on the fabric.

7. An improved method of hydroenhancing fabric (according to claim 6, wherein the drum manifold is arranged at a diagonal angle to the fabric travel direction to eliminate the generation of interference patterns in the fabric.

8. Equipment for hydroenhancing and finishing woven and knit fabric, including spun and/or spun filament yarn, comprising:

a manifold having a row of jet orifices which emit a curtain of fluid jets at a given level of total delivered energy per weight of fabric;

transport means for transporting the fabric in a travel direction at a given speed relative to the manifold so that the curtain of fluid jets impacts on the fabric;

wherein the manifold is operated in movement relative to the transporting of the fabric such that the curtain of fluid jets is delivered to the fabric at a low energy per pass which is a selected fraction of the given level of total delivered energy and in a high number of passes on the fabric which is a multiple corresponding to the selected fraction, the manifold is a drum manifold having a plurality of jet strips with respective rows of jet orifices mounted around the periphery thereof, said drum manifold being rotated to apply the fluid curtains from the plurality of jet strips in overlapping swathes to simulate multiple passes on the fabric, whereby an improved conversion of delivered energy to enhancement energy is obtained on each pass and waste of energy is reduced.

9. Equipment according to claim 8, wherein the drum manifold is arranged at a diagonal angle to the fabric travel direction to eliminate the generation of interference patterns in the fabric.

10. Equipment according to claim 8, wherein the drum manifold has three jet strips mounted thereon and is rotated to have a surface velocity in the fabric travel direction at four times the speed of fabric transport so as to simulate nine passes over the fabric in a process run.

11. Equipment according to claim 8, wherein the drum manifold has three jet strips mounted thereon and is rotated to have a surface velocity opposite to the fabric travel direction.

12. Equipment according to claim 11, wherein the drum manifold is rotated to have a surface velocity opposite to the fabric travel direction at four times the speed of fabric transport so as to simulate 15 passes over the fabric in a process run.

13. An improved method of hydroenhancing and finishing woven and knit fabric, including spun and/or spun filament yarn using a manifoid having a row of jet orifices which emit a curtain of fluid jets at a given level of total delivered energy per weight of fabric to impact on a side of the fabric as it is transported in a travel direction at a given speed relative to the manifold, wherein the improvement comprises operating the manifold in movement relative to the transporting of the fabric such that the curtain of fluid jets delivers a low energy to the fabric per pass which is a selected fraction of the given level of total delivered energy and in a high number of passes over the fabric which is a multiple corresponding to the selected fraction, the manifold is a drum manifold having a plurality of jet strips mounted thereto and is rotated to apply jet curtains in overlapping swathes to simulate multiple passes on the fabric, whereby an improved conversion of delivered energy to enhancement energy is obtained on each pass and waste of energy is reduced.

14. An improved method of hydroenhancing fabric according to claim 13, wherein the drum manifold is arranged at a diagonal angle to the fabric travel direction to eliminate the generation of interference patterns in the fabric.

15. An improved method of hydroenhancing fabric according to claim 13, wherein the manifold is provided with jet orifices which emit fan jets forming a continuous water curtain on the fabric in order to eliminate the generation of interference patterns in the fabric.

* * * * *